US009868296B2

(12) United States Patent
Davison et al.

(10) Patent No.: US 9,868,296 B2
(45) Date of Patent: Jan. 16, 2018

(54) ALIGNMENT SYSTEM FOR ARTICLES OF APPAREL

(71) Applicant: NIKE, Inc., Beaverton, OR (US)

(72) Inventors: Darren C. Davison, Aloha, OR (US); Jennifer Ross, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/246,135

(22) Filed: Aug. 24, 2016

(65) Prior Publication Data

US 2017/0072703 A1 Mar. 16, 2017

Related U.S. Application Data

(60) Provisional application No. 62/218,198, filed on Sep. 14, 2015.

(51) Int. Cl.

| | |
|---|---|
| ***B41J 3/407*** | (2006.01) |
| ***A41H 3/08*** | (2006.01) |
| ***B41J 11/04*** | (2006.01) |

(52) U.S. Cl.

CPC ..... *B41J 3/4073* (2013.01); *A41H 3/08* (2013.01); *B41J 3/4078* (2013.01); *B41J 11/04* (2013.01)

(58) Field of Classification Search

CPC ..... B41J 3/4073; B41J 3/4078; B41J 11/04; A41H 3/08

See application file for complete search history.

(56) References Cited

U.S. PATENT DOCUMENTS

| | | | | |
|---|---|---|---|---|
| 5,288,322 | A | 2/1994 | Hanna | |
| 9,266,353 | B2 * | 2/2016 | Beier | B41J 3/4073 |
| 2011/0036252 | A1 | 2/2011 | Middo | |
| 2015/0151552 | A1 | 6/2015 | Bevier et al. | |

FOREIGN PATENT DOCUMENTS

| | | |
|---|---|---|
| CN | 203831998 | 9/2014 |

OTHER PUBLICATIONS

International Search Report from PCT/US2016/048858 dated Dec. 14, 2016. 12 pp.

* cited by examiner

*Primary Examiner* — Thinh H Nguyen

(74) *Attorney, Agent, or Firm* — Klarquist Sparkman, LLP

(57) ABSTRACT

An alignment system for an article of apparel includes an article receptacle device for receiving an article to be printed. The alignment system also includes a receiving assembly for receiving an article receptacle device with an article to be aligned prior to printing. The alignment system can include one or more flexible sheets that can be used to help position the articles on the article receptacle device in preparation for printing.

20 Claims, 18 Drawing Sheets

ALIGNMENT SYSTEM FOR ARTICLES OF APPAREL

BACKGROUND

The present embodiments relate generally to alignment systems and in particular to alignment systems that can be used to align apparel during printing.

Printing systems may utilize various components such as a printing device. The printing device can include a printhead, as well as ink cartridges to supply ink to the printhead.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
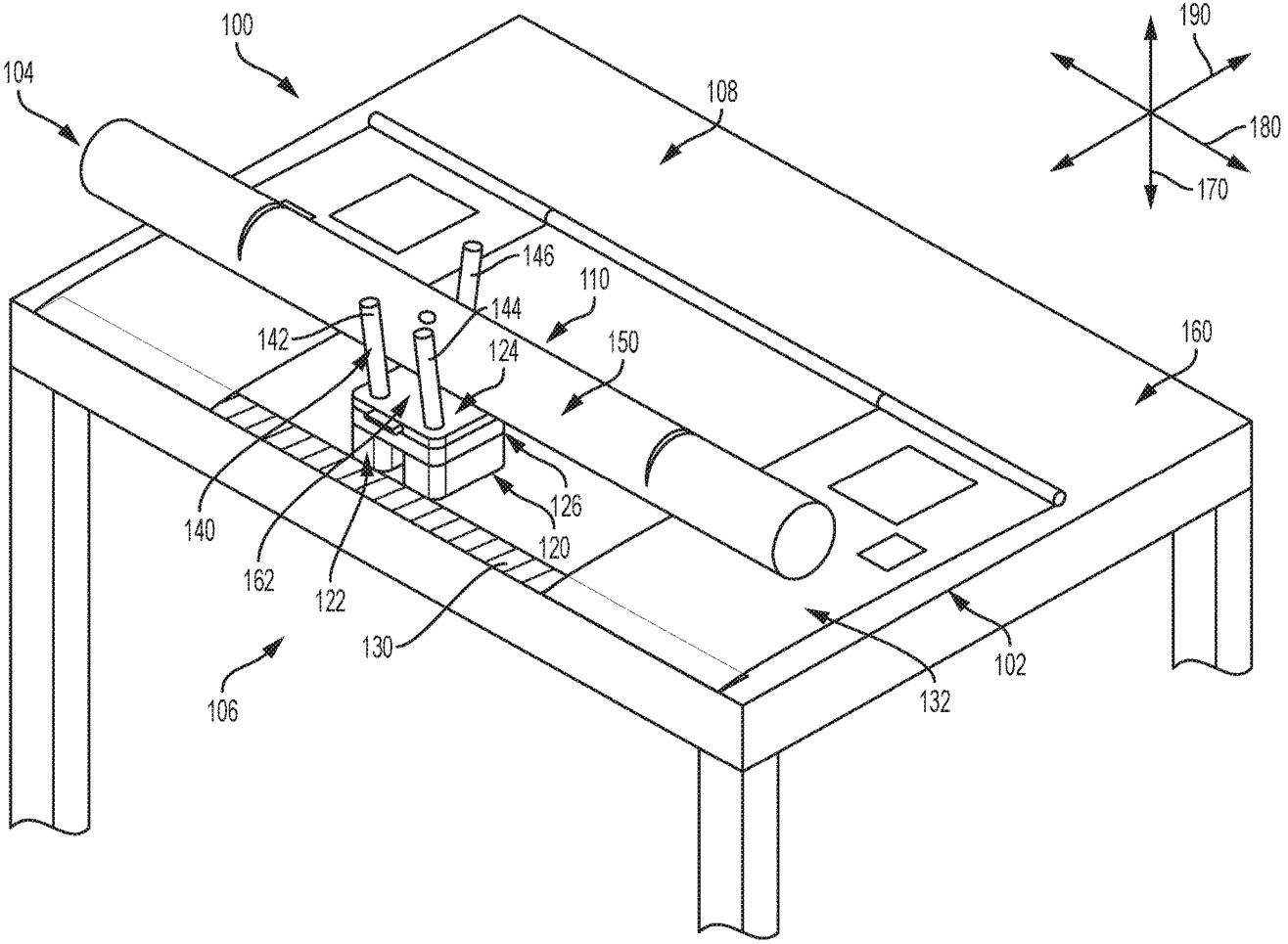
FIG. 1 is a schematic view of an embodiment of an alignment system.

In one aspect, the present disclosure is directed to an alignment system for printing comprising a receptacle configured to receive a first article of apparel, where the receptacle has a three-dimensional geometry and includes at least one curved surface, and a receiving base, where the receiving base is configured to receive the receptacle. The alignment system further includes a first sheet, where one side of the first sheet is fixed in position relative to the receiving base, and where the first sheet is configured to curve and extend around a portion of the circumference of the receptacle. The first sheet includes at least a first reference marker, where the first reference marker is configured to align at least a portion of the first article of apparel with the receptacle.

In another aspect, the present disclosure is directed to an alignment system for printing comprising a receptacle with a three-dimensional geometry, where the receptacle includes an outer surface. At least a portion of the outer surface of the receptacle is configured to receive a first article of apparel. The alignment system also includes a receiving base, where the receiving base is configured to receive the receptacle. The outer surface includes a lower region and an upper region. There is a first sheet configured to curve and extend around at least a portion of the lower region of the receptacle and at least a portion of the upper region of the receptacle when the receptacle is disposed in the receiving base. Furthermore, the first sheet has a first edge that is joined to a first support member. The receiving base includes a releasable retaining component, where the releasable retaining component is configured to engage with a portion of the first support member when the first sheet is extended around the receptacle, and where the releasable retaining component and the portion of the first support member are configured to secure the first sheet in position relative to the receptacle.

In another aspect, the present disclosure is directed to a method of operating a system for aligning an article of apparel, comprising placing a first article of apparel onto a receptacle, where the receptacle includes a curved surface, securing the receptacle in a receiving base, and selecting a first sheet from a plurality of sheets, where at least the first sheet is bound along one side by an anchor portion. The method further comprises wrapping the first sheet around at least a portion of the first article of apparel, where the first sheet includes at least a first reference marker, the first reference marker being configured to align at least the portion of the first article of apparel with the receptacle. In addition, the method includes unwrapping the first sheet from the first article of apparel, and mounting the receptacle with the first article of apparel in a printing system.

In another aspect, the present disclosure is directed to a method of making a sock, comprising placing the sock onto a receptacle, where the receptacle includes a curved surface, securing the receptacle in a receiving base, and selecting a first sheet from a plurality of sheets, where at least the first sheet is bound along one side by an anchor portion. The method further comprises wrapping the first sheet around at least a portion of the sock, where the first sheet includes at least a first reference marker, the first reference marker being configured to align at least the portion of the first sock with the receptacle. In addition, the method includes unwrapping the first sheet from the sock, mounting the receptacle with the sock in a printing system, and printing on a first region of the sock and excluding printing from a second region of the sock.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

Figure 2:
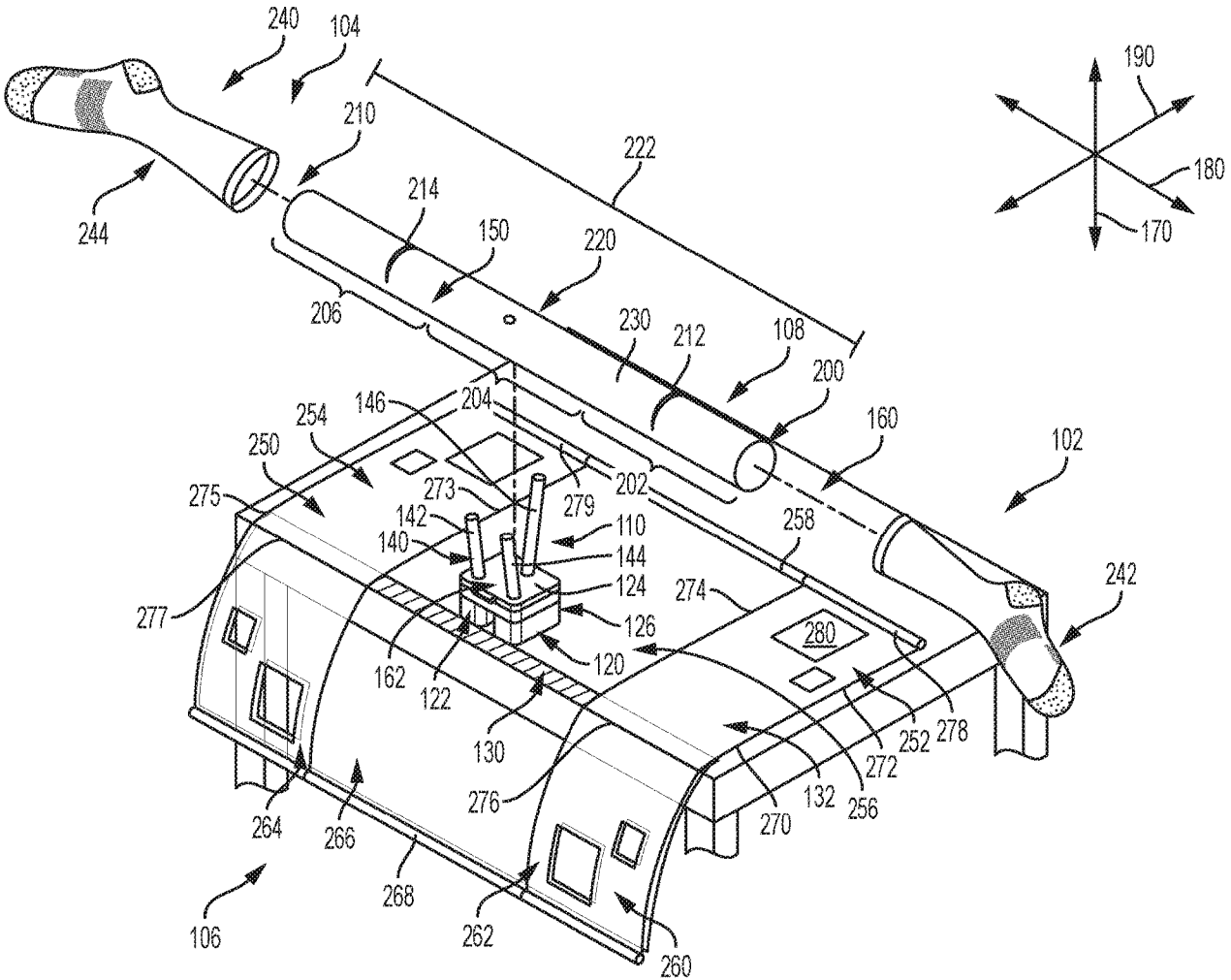
FIG. 2 is a schematic exploded view of an embodiment of an alignment system.

FIGS. 1 and 2 depict embodiments of an alignment system 100.

Generally, FIG. 1 illustrates an assembled embodiment of alignment system 100, and FIG. 2 depicts an exploded view of some components of alignment system 100. In different embodiments, alignment system 100 may include a receiving assembly 110, an anchoring portion (also herein referred to as an anchoring member 130), an article receptacle device 150, and/or one or more flexible sheets 132. In some cases, receiving assembly 110 may include a base portion 120 and one or more securing members 140. For purposes of illustration, only some components of alignment system 100 are shown in FIGS. 1 and 2. It will be understood that in other embodiments alignment system 100 may include additional provisions.

As will be discussed in detail further below, alignment system 100 can include provisions for facilitating the alignment of one or more articles with respect to article receptacle device 150 and a printing system (see FIG. 22). In some embodiments, it may be useful to provide a means of aligning an article within a printing system so as to ensure graphics (or other printed materials) are printed along desired portions of the article. In particular, alignment system 100 may include provisions for pre-aligning an article with article receptacle device 150, where article receptacle device 150 may accommodate articles of various types, shapes, and sizes.

The exemplary embodiment depicts alignment system 100 in the form of a tabletop structure. More generally, alignment system 100 could comprise a structure(s) that can be placed on a table or other raised areas, as well as a floor or ground area. It should be understood that while some portions of alignment system 100 could be fixedly attached to a surface, in some embodiments, one or more components of alignment system 100 may be readily moved from one location to another. In some cases, alignment system 150 may generally include a structure that allows alignment system 150 to stand or be otherwise independently stable when placed on a surface (e.g., without additional supportive components or mounting elements). In other embodiments, alignment system 150 could be a permanently mounted structure.

To assist and clarify the subsequent description of various embodiments, different terms are defined herein. Unless otherwise indicated, the following definitions apply throughout this specification (including the claims). For consistency and convenience, directional adjectives are employed throughout this detailed description corresponding to the illustrated embodiments.

The term "longitudinal" or "longitudinal direction(s)," as used throughout this detailed description and in the claims, refers to directions extending across a length or breadth of an element or component of alignment system 100. In some embodiments, a longitudinal axis 180 may extend from a first side 102 of alignment system 100 to a second side 104 of alignment system 100.

The term "lateral" or "lateral direction(s)," as used throughout this detailed description and in the claims, refers to directions extending along a width of a component or element. For example, a lateral axis 190 of alignment system 100 may extend between a third side 106 (the side closer to the viewer in the perspective of FIGS. 1 and 2) and a fourth side 108 (the side further from the viewer in the perspective of FIGS. 1 and 2) of alignment system 100.

The term "vertical," as used throughout this detailed description and in the claims, refers to directions generally perpendicular to both the lateral and longitudinal directions. For example, in cases where an alignment system is disposed on a ground surface, a vertical direction may extend from the ground surface upward. Thus, in FIGS. 1 and 2, a vertical axis 170 refers to the axis perpendicular to a horizontal surface defined by longitudinal axis 180 and lateral axis 190. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The term "side," as used in this specification and in the claims, refers to any portion of a component facing generally in a lateral, medial, forward, or rearward direction (as opposed to an upward or downward direction). In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, bolts, stitches, nails, staples, welding or other thermal bonding, or other joining techniques. In addition, two components may be "fixedly attached" by virtue of being integrally formed, for example, in a molding process.

For purposes of this disclosure, the term "removably attached" or "removably inserted" shall refer to the joining of two components or a component and an element in a manner such that the two components are secured together, but may be readily detached from one another. Examples of removable attachment mechanisms may include hook and loop fasteners, friction fit connections, interference fit connections, threaded connectors, magnetic connectors, cam-locking connectors, compression of one material with another, and other such readily detachable connectors.

Additionally, it will be understood that each of these directional adjectives may also be applied to individual components of alignment system 100, including, but not limited to, base portion 120, anchoring member 130, flexible sheets 132, article receptacle device 150, or other components.

In some embodiments, alignment system 100 may be associated with one or more articles of apparel ("articles") 240, as shown in FIG. 2. For example, referring to FIG. 2, articles 240 include a first article 242 and a second article 244. In FIG. 2, first article 242 is depicted as comprising a first sock, and second article 244 is depicted as comprising a second sock. In other embodiments however, alignment system 100 need not be limited to use with articles related to footwear, and the principles taught throughout this detailed description may be applied to additional articles as well. Generally, these principles could be applied to any article that may be worn. In some embodiments, the article may include one or more articulated portions that are configured to move. In other cases, the article may be configured to conform to portions of a wearer in a three-dimensional manner. Examples of articles that are configured to be worn include, but are not limited to, footwear, gloves, shirts, pants, socks, scarves, hats, jackets, as well as other articles. Other examples of articles include, but are not limited to, shin guards, kneepads, elbow pads, shoulder pads, as well as any other type of protective equipment. Additionally, in some embodiments, the article could be another type of article that is not configured to be worn, including, but not limited to, balls, bags, purses, backpacks, as well as other articles that may not be worn.

In some embodiments, alignment system 100 may include provisions for receiving one or more articles 240. In another embodiment, alignment system 100 may include provisions to secure articles 240 within the alignment system. In one embodiment, as noted above, alignment system 100 may include article receptacle device (also referred to herein as "receptacle") 150. In different embodiments, receptacle 150 may be associated with one or more articles of apparel, and can facilitate the receipt and or securing of articles 240, as will be discussed further below.

The term article receptacle device or receptacle, as used throughout this detailed description and in the claims, refers to any component, structure, container, or other element that can be configured to hold one or more articles of apparel. Moreover, in some embodiments, receptacle may be portable, such that it is configured to be moved from one location to another. Specifically, a portable receptacle may be any receptacle that is not required to be permanently secured to a surface in order for the alignment system to operate, and/or is not fixedly attached to another component. Thus, in some embodiments, receptacle 150 is capable of being displaced and/or moved to a new location. This feature of receptacle 150 will be discussed further below with respect to FIG. 22.

In some embodiments, receptacle 150 can include different regions or portions. As shown in FIG. 2, for purposes of reference, receptacle 150 may include a first receptacle end 200, a second receptacle end 210, and a receptacle midpoint 220. Furthermore, receptacle 150 may be divided into a first portion 202, an intermediate portion 204, and a second portion 206. As shown in FIG. 2, in some embodiments, first portion 202 may be disposed closer to or associated with first receptacle end 200, intermediate portion 204 may be disposed closer to or associated with receptacle midpoint 220, and second portion 206 may be disposed closer to or associated with second receptacle end 210.

In different embodiments, the shape of receptacle 150 can vary. In one embodiment, receptacle 150 may have a three-dimensional (i.e., a substantially non-flat) geometry. In some embodiments, receptacle 150 may be substantially cylindrical in shape. In embodiments where receptacle 150 has a substantially cylindrical shape, the cross-section of article receptacle device 150 may be substantially circular. However, other embodiments may utilize an article receptacle device having other kinds of cross-sectional shapes including rectangular, triangular, regular, irregular, as well as any other kinds of cross-sectional shapes. Moreover, in some embodiments, article receptacle device 150 may be substantially hollow and comprise a kind of tube. However, in other embodiments, article receptacle device 150 may not be hollow. Thus, in some embodiments, at least a portion of receptacle 150 may include a curved surface. In one embodiment, a substantial majority of the surface of receptacle 150 may comprise a curved surface. In another embodiment (for example, in embodiments where the receptacle is cylindrical), the curved surface may be substantially continuous and comprise a large majority of the shape of receptacle 150.

In one embodiment, first portion 202, intermediate portion 204, and second portion 206 of receptacle 150 can together comprise the cylindrical shape of receptacle 150. Furthermore, in some embodiments, receptacle 150 may include an outer surface 230, where outer surface 230 is an outer-facing surface (i.e., an external surface) associated with the circumference of the receptacle. In one embodiment, outer surface 230 can comprise a generally smooth, even surface or an untextured surface. However, in other embodiments, some regions of outer surface 230 may exhibit textures or other surface characteristics, such as dimpling, protrusions, ribs, or various patterns, for example. In some other cases, outer surface 230 may include uneven regions, protrusions, bumps, gaps, ridges, and/or openings. For example, in FIG. 2, receptacle 150 includes a first slot 212 disposed in first portion 202 and a second slot 214 disposed in second portion 204. In some embodiments, first slot 212 and second slot 214 may facilitate the loading and/or securing of articles 240 along receptacle 150 by providing a securing or attachment region for an article. Furthermore, as noted above, in some embodiments, outer surface 230 may include a curved surface.

In some cases, receptacle 150 may be dimensioned along a set of axes. For example, receptacle 150 may have a longitudinal length 222, running lengthwise along longitudinal axis 180 and extending between first receptacle end 200 and second receptacle end 210. In some embodiments, receptacle midpoint 220 may demarcate the middle of receptacle 150 where first receptacle end 200 and second receptacle end 210 are equidistant. In some embodiments, receptacle 150 may have more receptacle ends.

As will be discussed with respect to FIGS. 3 and 4 below, in some embodiments where article receptacle device 150 has a substantially cylindrical geometry, receptacle 150 may receive an article with a substantially tubular geometry, such as first article 242 or second article 244. In some embodiments, for example, when an article such as first article 242 is placed at first receptacle end 200 and mounted onto article receptacle device 150, first article 242 may conform to the cylindrical shape of article receptacle device 150.

As shown in FIGS. 1 and 2, and in different embodiments, alignment system 100 may include provisions for removably attaching or securing receptacle 150 with another component of alignment system 100. As noted above, alignment system 100 includes receiving assembly 110 that includes base portion 120 and securing members 140. Base portion 120 may be disposed along or mounted on mounting surface 160 in some embodiments. For purposes of this disclosure, a mounting surface is a generally flat or stable area, such as a table or other raised area. A mounting surface can also comprise a floor or ground area. In FIGS. 1 and 2, mounting surface 160 is illustrated as a table upon which base portion 120 is fixedly attached. However, in other embodiments, base portion 120 may be removably attached to mounting surface 160.

In different embodiments, the shape of base portion 120 can vary. In one embodiment, the shape of base portion 120 can include contours to facilitate the receipt or securement of receptacle 150. In some cases, base portion 120 may have a substantially box-like shape. In other cases, base portion 120 may have an approximately cuboid or rectangular prism shape. Examples of other shapes for base portion 120 include, but are not limited, to curved or rounded shapes, polygonal shapes, regular shapes, irregular shapes as well as any other kinds of shapes. In FIGS. 1 and 2, it can be seen that base portion 120 includes a forward portion 122, a central portion 124, and a rearward portion 126, where forward and rearward are relative to the viewpoint of the reader with respect to the perspective of FIGS. 1 and 2. In other words, forward portion 122 is disposed closer to third side 106, and rearward portion 126 is disposed closer to fourth side 108.

In some embodiments, base portion 120 may include one or more securing members 140. Securing members 140 may be attached to base portion 120 to form a receiving area 162 in receiving assembly. Thus, in some embodiments, securing members 140 can be arranged in a manner that facilitates the secure receipt of receptacle 150.

In different embodiments, securing members 140 may comprise various shapes. In one embodiment, securing members 140 may include generally elongated elements that are joined to or disposed in base portion 120. For example, securing elements 140 can comprise generally rigid rods or bars in some cases. In FIGS. 1 and 2, first securing member 142, second securing member 144, and third securing member 146 extend upward from base portion 120 in a direction generally aligned with vertical axis 170. However, in other embodiments, one or more securing members may be disposed at angles or orientations that differ from those illustrated here. Furthermore, in different embodiments, securing members 140 may be associated with various regions of base portion 120. For example, in FIGS. 1 and 2, first securing member 142 and second securing member 144 are disposed in forward portion 122, and third securing member 146 is disposed in rearward portion 126. In other embodiments, securing members 140 may be disposed in other regions of base portion 120, including central portion 124. In addition, in some cases, securing members 140 may be moved, reinserted, and/or disposed along another region of base portion 120. For example, in one embodiment, base portion 120 may include one or more receiving slots that can snugly accommodate at least a portion of one or more additional securing members 140. In some embodiments, securing members 140 may be rearranged or inserted into different receiving slots to produce a differently dimensioned receiving area 162, or a receiving area disposed toward rearward portion 126, for example. This can allow receipt of differently sized or dimensioned receptacles in some embodiments.

In one embodiment, two or more securing members 140 may be substantially similar in shape and dimensions. However, in other embodiments, two or more securing members 140 may be substantially different from one another in shape and dimensions. In FIGS. 1 and 2, first securing member 142 and second securing member 144 are substantially similar in size and shape, while third securing member 146 is larger than both first securing member 142 and second securing member 144. Thus, in some embodiments, a securing member can be larger in length and/or girth relative to another securing member.

In some embodiments, it may be useful to provide a means of aligning an article such that the article can be placed in a printing system and printed information is generally printed only on the desired portions of the article. Thus, in different embodiments, alignment system 100 can include provisions for centering or aligning an article loaded on article receptacle device 150. In some embodiments, these provisions facilitate subsequent printing at correct locations or regions of an article (see, for example, the discussion below with respect to FIGS. 22-24). In an exemplary embodiment, article receptacle device 150 of alignment system 100 may be associated with a type of alignment guide or template. In some embodiments, the templates can be axially or circumferentially aligned for centering or positioning an article in a known or desired position relative to the receptacle. For example, the template or alignment guide may be used to referentially position a first side of first article 242 when mounted on article receptacle device 150. In some cases, a printing system may be provided with a point or points of reference for printing on the correct or desired portions of the article through the use of alignment system 100. In some cases, alignment system 100 may include multiple alignment guides or templates.

For example, in some embodiments, alignment system 100 can include one or more flexible sheets ("sheets") 132, as noted above. In some embodiments, sheets 132 (or substantial portion of sheets 132) may comprise a substantially flat or two-dimensional material or structure. The term "two-dimensional" as used throughout this detailed description and in the claims refers to any generally flat material exhibiting a length and width that are substantially greater than a thickness of the material. Although two-dimensional materials may have smooth or generally untextured surfaces, some two-dimensional materials will exhibit textures or other surface characteristics, such as dimpling, protrusions, ribs, or various patterns, for example. In other embodiments, the geometry of sheets 132 could vary and could include various contours.

Furthermore, sheets 132 may comprise various materials. In some embodiments, the materials may include light-diffusive, light-transmissive, translucent, and/or transparent materials. Such materials can facilitate the arrangement or placement of sheets 132 along various portions of an article or receptacle 150. However, in other embodiments, sheets 132 may be made of materials that are non-transparent or non-translucent.

Sheets 132 may be made of various generally flexible or deformable materials in different embodiments. For example, sheets 132 can comprise a silicone, rubber, or other type of synthetic or plastic material. In some embodiments, materials comprising sheets 132 may be substantially waterproof, water-resistant, and/or substantially impermeable to steam and other gas or fluids.

Each of sheets 132 may include different shapes and sizes in some embodiments. As an example, a first sheet 250 and a second sheet 260 are shown in FIG. 2. First sheet 250 is disposed in a generally flat manner across mounting surface 160, extending behind (from the viewer's perspective) receiving assembly 110. First sheet 250 includes a first sheet portion 252, a second sheet portion 254, a first gap 256, and a first support member 258. Similarly, second sheet 260 includes a third sheet portion 262, a fourth sheet portion 264, a second gap 266, and a second support member 268.

Thus, in different embodiments, sheets 132 may include one or more sheet portions. For purposes of this disclosure, a sheet portion is a portion of a flexible sheet that is configured for use with one article of apparel at a time (i.e., during one session of alignment system 100 with articles). For example, first sheet portion 252 may be configured for use with first article 242 and second sheet portion 254 may be configured for use with second article 244. It should be understood that one or more sheets may be configured for use with the same article. For example, in one embodiment, third sheet portion 262 may also be configured for use with first article 242, and fourth sheet portion 264 may also be configured for use with second article 244. Thus, both first sheet portion 252 and third sheet portion 262 may be used with first article 242. Furthermore, first sheet portion 252 may be configured for use with second article 244, and second sheet portion 254 may be configured for use with first article 242.

In addition, it should be understood that a single sheet may include only one sheet portion or more than two sheet portions. For example, in other embodiments, first sheet 250 may include first sheet portion 252, without additional second sheet portion 254, such that first sheet 250 is generally configured for use with only one article of apparel at a time. However, in the embodiments illustrated herein, first sheet 250 includes two sheet portions and is configured for use with two articles of apparel at a time.

In different embodiments, the shape of each sheet portion may vary. In some embodiments, a sheet portion (e.g., first sheet portion 252) may comprise a generally rectangular, square, or trapezoidal shape. In FIG. 2, first sheet portion 252 has a generally rectangular shape. In other embodiments, the perimeter and shape of a sheet portion may vary from what is depicted here, and include any regular or irregular shape.

For purposes of reference, an outer perimeter 270 of a single sheet portion may be demarcated and labeled along its edges. Thus, as an example, first sheet portion 252 comprises a first edge 272 disposed toward first side 102, a second edge 274 disposed toward second side 104, a third edge 276 disposed toward third side 106, and a fourth edge 278 disposed toward fourth side 108. Similarly, other sheet portions may include various edges. For example, second sheet portion 254 comprises a fifth edge 273 disposed toward first side 102, a sixth edge 275 disposed closer to second side 104, a seventh edge 277 disposed toward third side 106, and an eighth edge 279 disposed closer to fourth side 108.

As noted above, flexible sheets 132 may include multiple sheet portions in different embodiments. In some embodiments, two or more sheet portions may be spaced apart from one another. For example, referring to first sheet 250, first sheet portion 252 and second sheet portion 254 are spaced apart by first gap 256. Similarly, third sheet portion 262 and fourth sheet portion 264 of second sheet 260 are spaced apart by second gap 266. As will be discussed further below with respect to FIGS. 8 and 9, in some embodiments, the gaps (e.g., first gap 256 and/or second gap 266) included in a flexible sheet may allow the flexible sheet to be turned or displaced while accommodating various components of alignment system 100. However, it should be understood that in other embodiments, different sheet portions may be placed directly adjacent to one another (e.g., second edge 274 is directly adjacent to fifth edge 273), or may be disposed such that they overlap one another, and no gap between sheet portions is associated with the flexible sheet.

In different embodiments, one or more flexible sheets 132 may include provisions for manipulating, moving, gripping, and/or turning each sheet. Furthermore, sheets 132 may include provisions for holding or arranging multiple sheet portions, and/or providing support or a structural frame to sheet portions. For example, each of sheets 132 can include one or more support members (for example, first support member 258 and second support member 268). In some embodiments, a support member can comprise a generally elongated element joined to a portion or edge of sheet portions. In some cases, a support member can comprise generally rigid rods or bars. In some embodiments, a support member may be weighted, providing a sheet with greater stability. Referring to FIG. 2, as noted earlier, first sheet 250 includes first support member 258 and second sheet 260 includes second support member 268. It can be seen that in one embodiment, first support member 258 extends in a direction substantially aligned with longitudinal axis 180. Furthermore, in one embodiment, first support member 258 can contact and join with fourth edge 278 of first sheet portion 252. First support member 258 may extend across first gap 256 and contact and join with eighth edge 279 of second sheet portion 254 in some embodiments. Second support member 268 can contact one or more edges of third sheet portion 262 and fourth sheet portion 264 in a similar manner.

As shown in FIG. 2, in some embodiments, a sheet portion can include one or more apertures 280. For purposes of this description, apertures 280 are openings, apertures, holes, cutouts, or spaces that are disposed within the sheet portion. Generally, apertures 280 can extend any distance, and along any orientation, across the sheet portion.

In some embodiments, apertures 280 have a rounded shape. In other embodiments, apertures 280 may include a wide variety of other geometries, including regular and irregular shapes. Apertures 280 may have shapes that are oblong, square, rectangular, elliptical, oval, or triangular, for example. In some embodiments, apertures 280 may have a variety of geometric shapes that may be chosen to impart specific functional uses to a sheet portion, and allow the sheet portion to provide alignment markers for one or more articles 240. Apertures 280 will be described further below with respect to FIGS. 15-20.

In different embodiments, in cases where a flexible sheet includes a plurality of sheet portions, two or more of the sheet portions comprising a single flexible sheet may be symmetrical. For purposes of this description, the terms "symmetrical" and "asymmetrical" are used to characterize two or more sheet portions. As used herein, two sheet portions have a symmetric configuration when a pair of sheet portions has symmetry about some common axis. In other words, a pair of sheet portions has a symmetric configuration when one sheet portion is a mirror image of the other sheet portion. In contrast, two sheet portions have an asymmetric configuration when there is no axis about which the sheet portions have symmetry. In other words, a pair of sheet portions comprising a single flexible sheet is asymmetrically configured when the mirror image of one sheet portion is not identical to the other sheet portion. For example, in one embodiment, the aperture pattern(s) associated with first sheet portion 252 are not the same as the aperture pattern(s) on the complementary second sheet portion 254 when the two sheet portions face one another in a mirror-image configuration. In another embodiment, two sheet portions that are otherwise similar can be asymmetric when the position of a first reference marker formed in the first sheet portion and the position of a second reference marker formed in the second sheet portion do not correspond or align when the two sheet portions are stacked together or disposed such that one (first) sheet is over the other (second) sheet. Thus, asymmetric can mean the sheet portions have no axis about which the aperture pattern(s) associated with two complementary sheet portions can be made symmetric (e.g., line up), or correspond exactly with one another.

For purposes of this discussion, a complementary pair of sheet portions refers to two sheet portions that comprise single flexible sheet and are designed to be used with a pair of articles in alignment system 100. For example, when two articles 240 (here, first article 242 and second article 244) are disposed on receptacle 150, first sheet 250 may be applied to both articles 240 in a generally simultaneous manner. Thus, in this case, first sheet portion 252 and second sheet portion 254 are complementary. Depending on the desired use of a flexible sheet, first sheet 250 may be designed for alignment of two similarly dimensioned articles 240 and include a symmetric pair of complementary sheet portions. However, in other embodiments, first sheet 250 may be designed for two differently dimensioned articles 240 and include an asymmetric pair of complementary sheet portions.

It may be further understood that the characterizations of symmetric and asymmetric may be with reference to all features of the sheet portions, or with reference to only some subset of features. In particular, given a feature of the sheet portions, the sheet portions may be considered as symmetric or asymmetric with respect to that feature. In the following embodiments, for example, specific consideration is given to the asymmetry of the sheet portions with respect to one or more apertures that are formed in the sheet portion. It should also be understood that while a pair of sheet portions may generally include some level of asymmetry, the asymmetry described herein is primarily directed to asymmetry in the location or number, shape, size, geometry, and/or orientation of apertures in the sheet portions.

Sheets 132 may be connected to and/or secured within alignment system 100 in various ways. In some embodiments, sheets 132 may be joined along one side to alignment system 100. In one embodiment, sheets 132 may be joined along one or more edges to alignment system 100. For example, as shown in FIG. 2, third edge 276 of first sheet portion 252 and seventh edge 277 of second sheet portion 254 (representing third side 106 of first sheet 250) are attached to alignment system 100 along anchoring member 130.

Anchoring member 130 may be joined to mounting surface 160 in some embodiments. In one embodiment, anchoring member 130 is fixedly attached to mounting surface 160. Thus, in some embodiments, anchoring member 130 can comprise a region where various components of alignment system 100 (e.g., a portion of first sheet 250) can be mounted, attached, or otherwise secured. The attachment may be mechanical or chemical in some embodiments, and can be formed through bolts, sewing, stitching, fusion, bonding (by an adhesive or other agents), glue, or a combination thereof. In some cases, anchoring member 130 can provide stability during the use of alignment system 100, and a stable, secure reference position for sheets 132. In other embodiments, anchoring member 130 may be different from what is illustrated here, and flexible sheets 132 may be secured in alignment system 100 through other means. For example, one or more sheets 132 may be directly attached to mounting surface 160.

In different embodiments, anchoring member 130 may comprise an anchoring portion of various shapes and dimensions. In some embodiments, anchoring member 130 may comprise an elongated rod or panel. In one embodiment, anchoring member 130 may extend from first side 102 to second side 104 of alignment system 100. In some cases, anchoring member 130 may be disposed such that it is substantially aligned with longitudinal axis 180. In different cases, the length of anchoring member 130 may extend continuously from first side 102 to second side 104, or there may be breaks or discontinuities throughout anchoring member 130.

Furthermore, alignment system 100 may include provisions for adjustment or movement of sheets 132 in some embodiments. For example, anchoring member 130 may function as a hinge region, binding one side of sheets 132. In one embodiment, sheets 132 may be rotated, pivoted, swiveled, swung, or otherwise moved back and forth along the hinge region associated with anchoring member 130. In another embodiment, one or more sheets 132 may be turned in a manner similar to a page that is bound to the spine of a book. The degree of rotation permitted to sheets 132 may vary in different embodiments. In some cases, anchoring member 130 may be configured to allow rotation of over 180 degrees. In other cases, rotation may be limited to 180 degrees, less than 180 degrees, or be substantially close to 90 degrees.

The materials comprising sheets 132 may also affect the ability of sheets 132 to be adjusted or moved. Thus, in some embodiments, sheets 132 may include substantially flexible materials, allowing sheets 132 to be bent or curved back so that sheets 132 more readily conform to the shape of receptacle 150 or articles 240, for example. In other embodiments, sheets 132 may include more rigid materials that inhibit the bending of sheets 132 and increase the amount of resistance of sheets 132 to deformation. In another embodiment, sheets 132 may include areas that are more flexible and areas that are more rigid. The operation of alignment system 100 and specifically, the rotation of sheets 132 in alignment system 100, will be discussed further with respect to FIGS. 6-9.

As noted above, in some cases, an article can be secured in alignment system 100 with the use of article receptacle device 150. FIG. 3 depicts a partial schematic view of a receptacle that may hold one or more articles, such as first article 242 and second article 244. Prior to or after mounting receptacle 150 in alignment system 100, an article may be loaded or placed onto article receptacle device 150. As shown in FIG. 3, articles 240 may comprise a pair of socks in some cases. FIGS. 3 and 4 show second article 244 as loaded and arranged over second receptacle end 210 of article receptacle device 150. In some embodiments, an additional article may be loaded on article receptacle device 150. For example, referring to FIG. 3, first article 242 can be initially associated with article receptacle device 150 by arranging a first article end 332 in the vicinity of a cuff portion 334 of first article 242 over first receptacle end 200. First article 242 may be pulled toward receptacle midpoint 220 of article receptacle device 150 until a second article end 336 in the vicinity of a toe portion 338 is taut against first receptacle end 200. In some embodiments, once first article 242 is loaded onto article receptacle device 150, a circumferential positioning member (not shown) may be used to further secure first article 242 in place.

Figure 4:
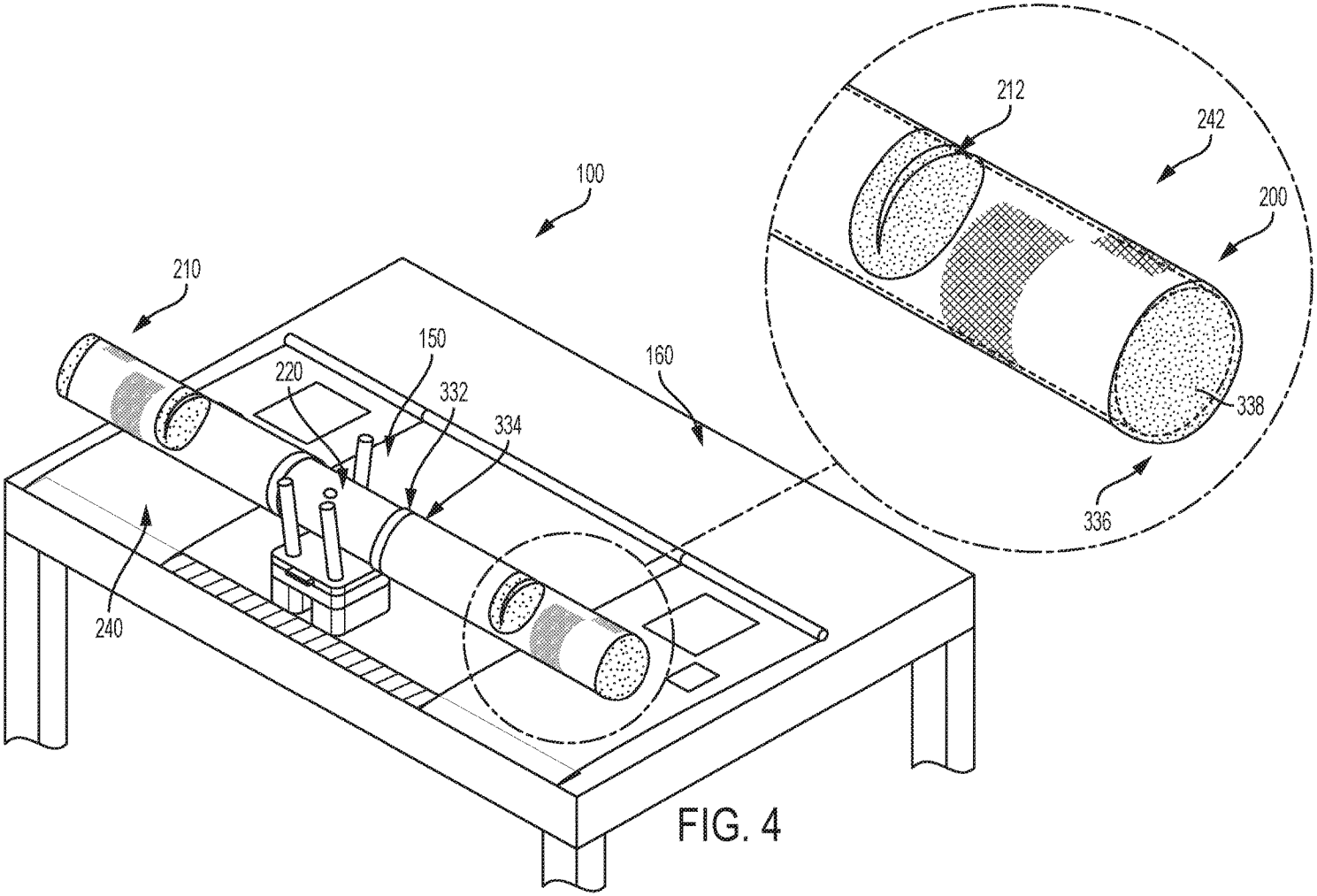
FIG. 4 is a schematic view of an article of apparel placed onto a receptacle device.

Once first article 242 has been slid onto article receptacle device 150, first article 242 may be loaded and secured on receptacle 150, as shown in FIG. 4. In some embodiments, first article 242 may be secured such that a portion of outer surface 230 associated with first portion 202 of receptacle 150 is in contact with at least a portion of an interior surface (not shown) of first article 242. Thus, in one embodiment, at least a portion of the outer surface of receptacle 150 can be configured to receive (or be inserted within) an article of apparel.

In some embodiments, first article 242 may be loaded onto article receptacle device 150, and receptacle 150 may be mounted into receiving assembly 110 for further alignment. In some embodiments, second article 244 may also be mounted onto article receptacle device 150 prior to the mounting of receptacle 150 in the receiving area. For example, second article 244 may be slid onto receptacle 150 from second receptacle end 210. However, in other embodiments, mounting of the receptacle may occur prior to the loading of an article (i.e., articles may be loaded while the receptacle is installed on the receiving assembly).

In some embodiments, first article 242 and second article 244 may comprise substantially similar article types (e.g., where first article 242 and second article 244 both comprise a sock). Furthermore, in one embodiment, first article 242 and second article 244 that comprise similar article types may also comprise substantially similar article dimensions (e.g., where first article 242 and second article 244 both comprise a sock of the same standard size, as defined below). In addition, in some embodiments, first article 242 and second article 244 that comprise similar article types may also comprise substantially similar article designs (e.g., where first article 242 and second article 244 both comprise the same markings, materials, and/or texturing). However, in other embodiments, first article 242 and second article 244 may be substantially different from one another in type, size, dimensions, design, and other properties or features.

Figure 5:
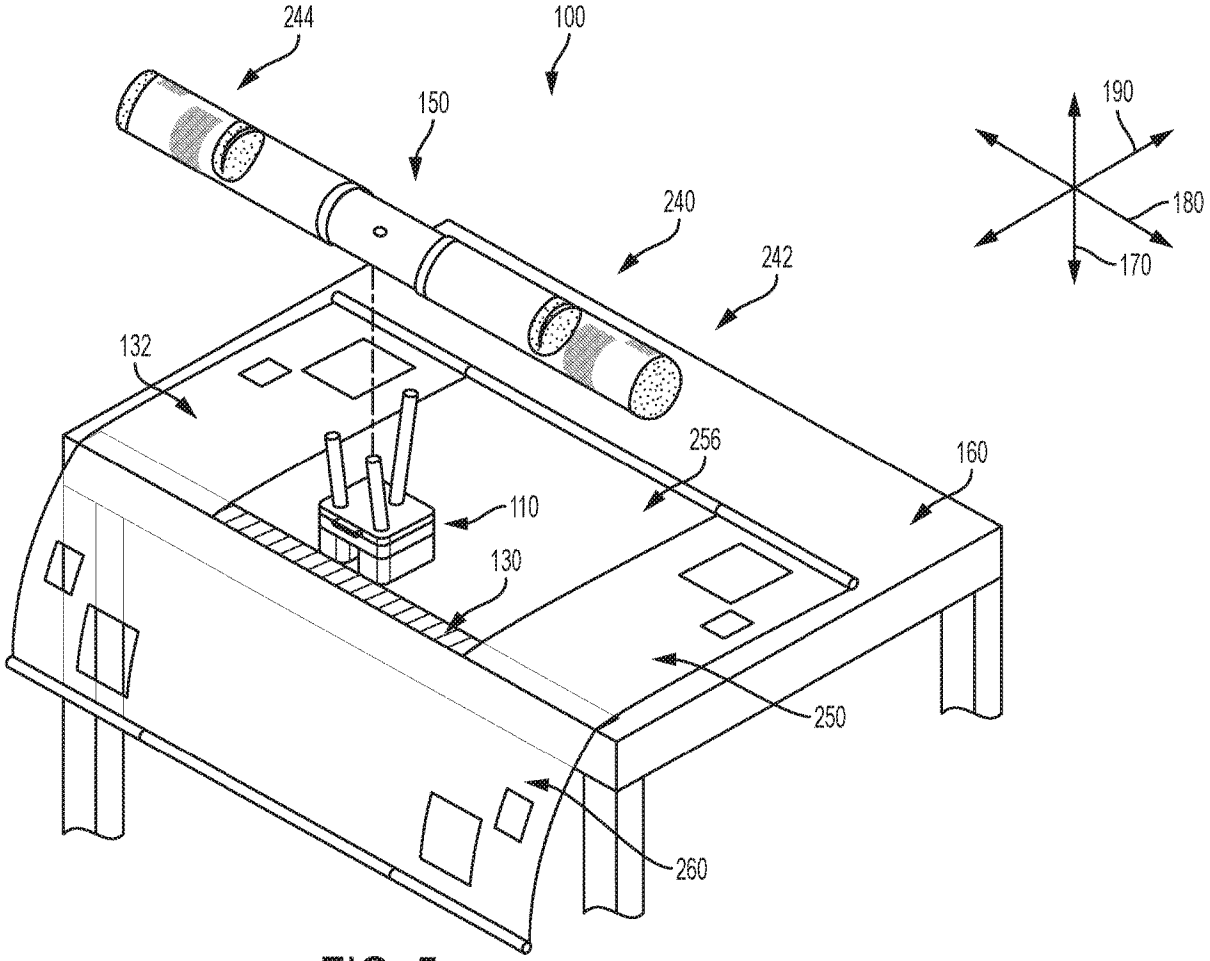
FIG. 5 is a schematic view of an embodiment of an alignment system.

Referring now to FIG. 5, alignment system 100 is shown with receptacle 150 disposed above receiving assembly 110. As shown in the example of FIGS. 3 and 4, first article 242 and second article 244 have been loaded onto receptacle 150. First sheet 250 extends in a rearward direction (from the viewer's perspective) from anchoring member 130, and extends across mounting surface 160. In addition, second sheet 260 extends from anchoring member 130 in a forward direction (from the viewer's perspective) and curves downward toward a lower surface (not shown) in a direction substantially aligned with vertical axis 170. Thus, it may be understood that both first sheet 250 and second sheet 260 may be joined together or bound along anchoring member 130, as will be discussed further below with respect to FIG. 21.

Figure 6:
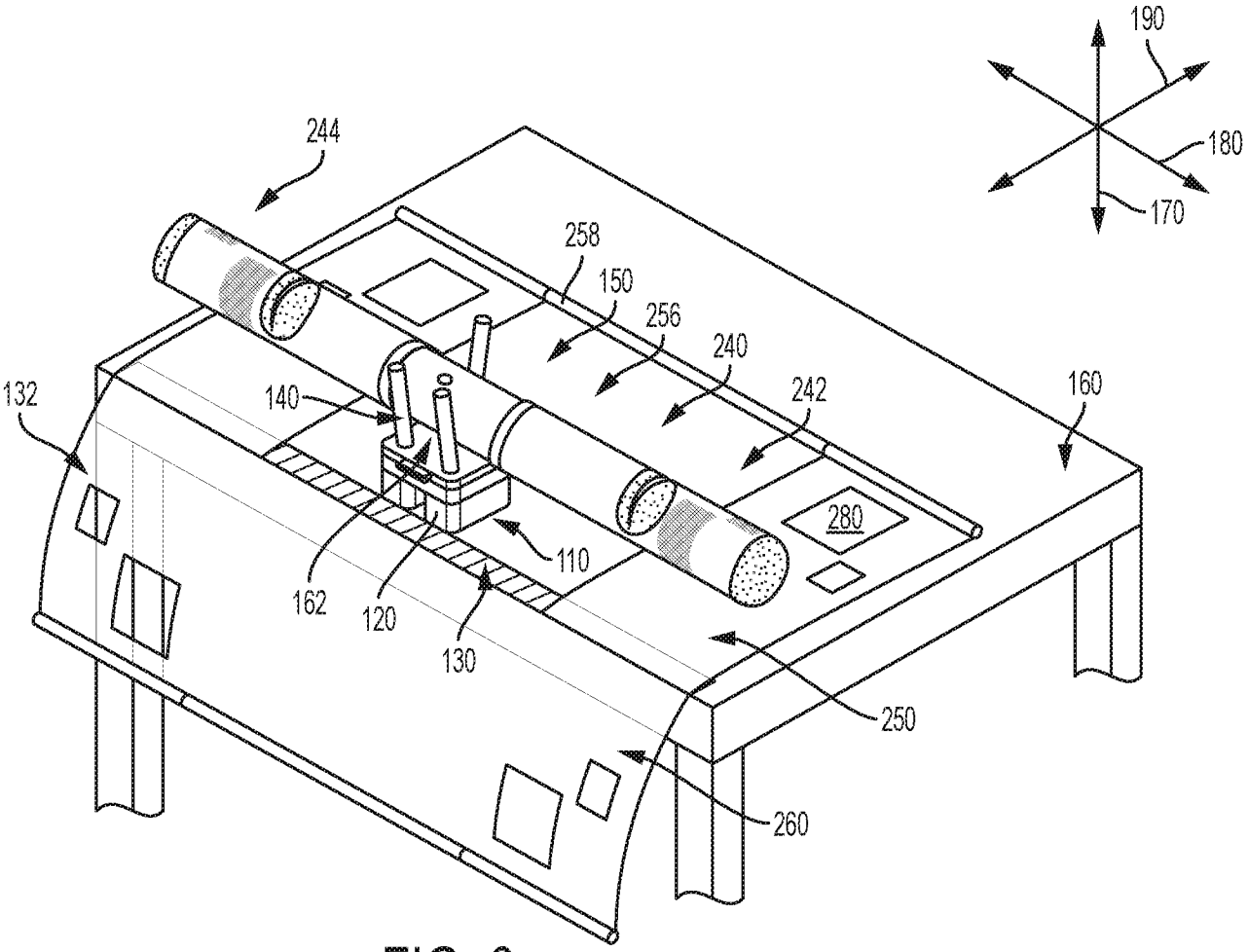
FIG. 6 is a schematic view of an embodiment of an alignment system.

In FIG. 6, receptacle 150 has now been inserted into receiving assembly 110. As noted above, in some embodiments, alignment system 100 may include provisions to receive receptacle 150. In some embodiments, provisions may include receiving area 162 formed by securing members 140 disposed along base portion 120. In some embodiments, receiving area 162 may include features to secure receptacle 150 with receiving assembly 110. In some embodiments, for example, a receptacle positioning member (not shown) may be included and used to secure or engage with at least one portion of receptacle 150 within receiving area 162. In some cases, a removable attachment or connection can be made by inserting an alignment positioning portion of receptacle 150 into a component of receiving assembly 110. In another case, a removable attachment or connection can be made by inserting an alignment positioning portion of a component of receiving assembly 110 into receptacle 150.

In other embodiments, there may be other provisions for positioning receptacle 150 within receiving assembly 110 in a particular circumferential orientation or position. In some embodiments, receptacle 150 may be locked or fixed in a consistent position each time receptacle 150 is inserted or mounted into receiving area 162. In other words, receptacle 150 may be disposed in a particular, consistent alignment with respect to base portion 120 and held in a stable position throughout use of alignment system 100 in some embodiments. This can be particularly beneficial when receptacle 150 is subsequently used in a printing system, as will be discussed below with respect to FIGS. 22-24.

Thus, in some embodiments, receiving assembly 110 may be specifically adapted to secure an article and/or receptacle 150 in a fixed position or orientation. For example, some embodiments of receiving assembly 110 may include various kinds of mounting devices, harnesses, or other provisions that may temporarily fix or hold the position of receptacle 150 relative to base portion 120. Such provisions may help to precisely orient a specific portion of an article toward a flexible sheet (and correspondingly toward a printer, as discussed in FIG. 21). For example, some embodiments could utilize a harness that fixes the orientation and position of receptacle 150 on receiving assembly 110 so that one or more apertures 280 of a flexible sheet can be associated with the desired portions of the articles that are loaded on receptacle 150. These provisions may also reduce the tendency of an article to move or jostle as various components of alignment system 100 are adjusted.

Figure 7:
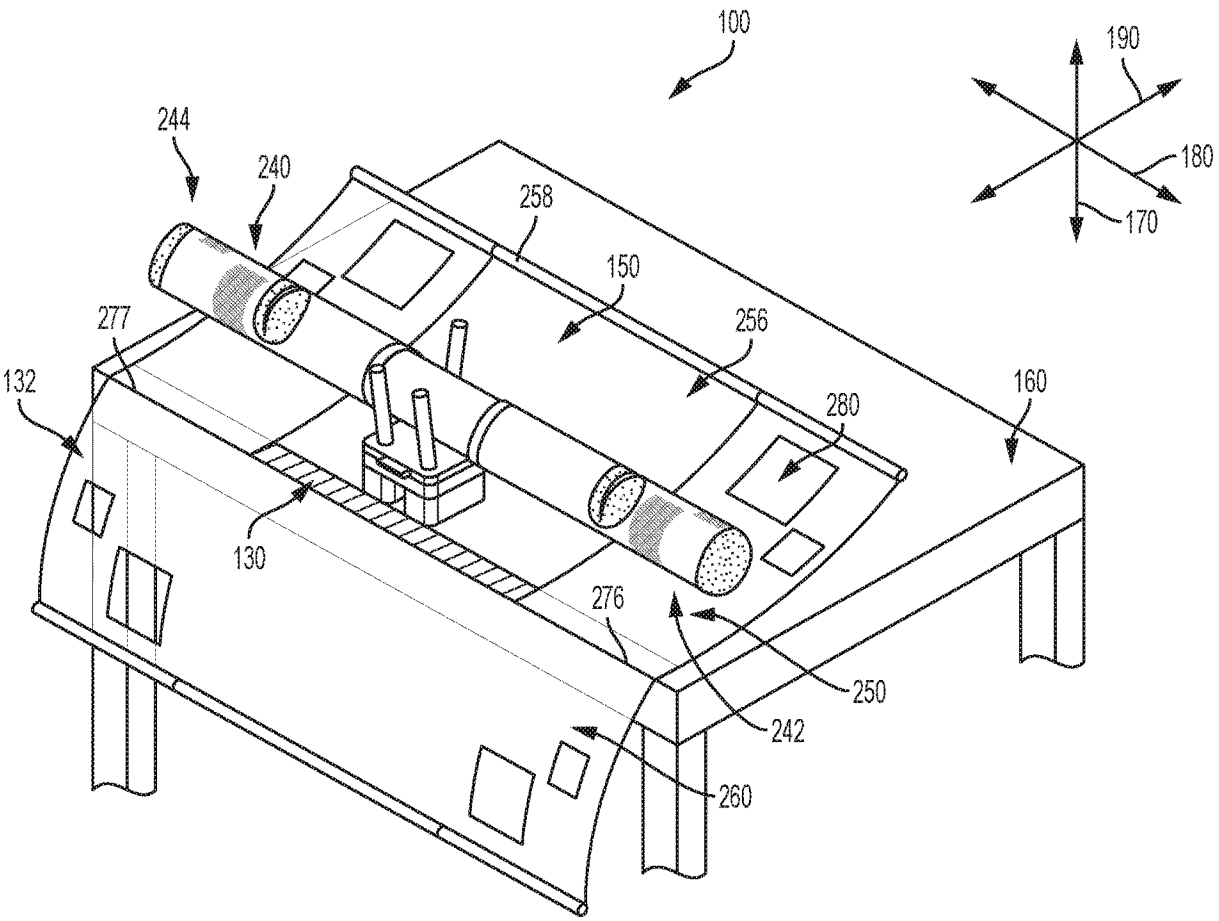
FIG. 7 is a schematic view of an embodiment of the use of an alignment system.
Figure 8:
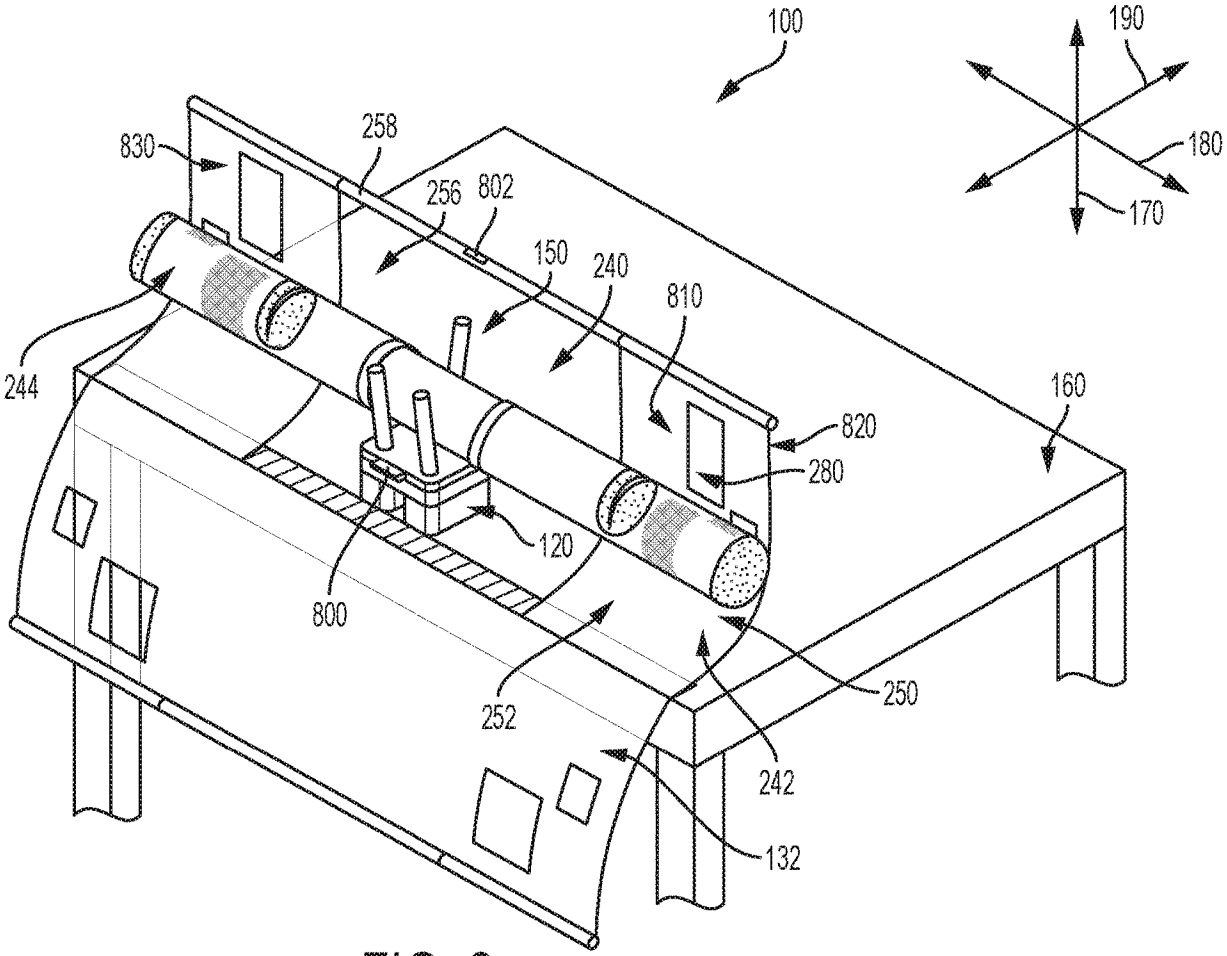
FIG. 8 is a schematic view of an embodiment of the use of an alignment system.
Figure 9:
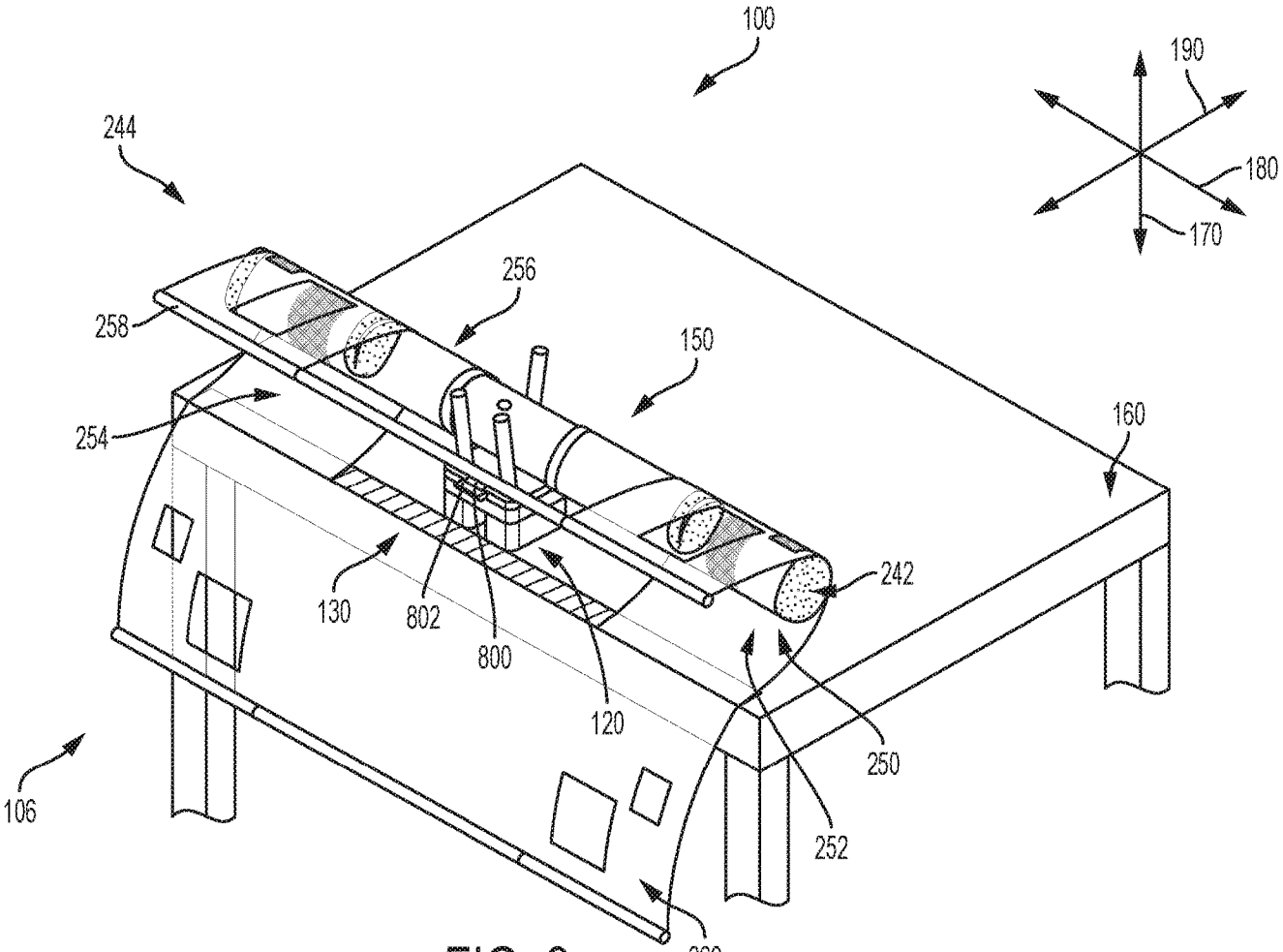
FIG. 9 is a schematic view of an embodiment of the use of an alignment system.

During use of alignment system 100, flexible sheets 132 may be moved or displaced, as described earlier. In FIGS. 7-9, an embodiment of the application of flexible sheets 132 along receptacle 150 and corresponding articles 240 is depicted. In FIG. 7, an isometric view of alignment system 100 is shown. First sheet 250 has been selected for use, and is being shown as it is raised both upward (in a vertical direction) and forward (toward the viewer). In some embodiments, first support member 258 may be used to help move first sheet 250 from an initial, first position as shown in FIG. 6 (where first sheet 250 is disposed "at rest" and substantially flat across mounting surface 160) to a second position of first sheet 250, depicted in FIG. 7. For example, a user may grasp a portion of first support member 258 to grip the framework of first sheet 250 and move first sheet 250 in different directions.

As first sheet 250 is raised upward, it remains bound along third edge 276 and seventh edge 277 to anchoring member 130. Thus, anchoring member 130 can limit and/or guide the motion of first sheet 250 in some embodiments. For example, as described above, anchoring member 130 can provide a hinge region that directs the motion of first sheet 250 such that it is able to rotate around the axis defined by anchoring member 130.

In FIG. 8, first sheet 250 is shown in a third position as it initially makes contact with a portion of articles 240 loaded on receptacle 150. A portion of a first surface 810 of first sheet portion 252 can be seen contacting a portion of first article 242. First surface 810 may be understood to refer to the side of first sheet 250 that faces upward when first sheet 250 is in the first position of FIG. 6. In addition, a second surface 820 may comprise the opposing surface side of first sheet 250, such that second surface 820 faces mounting surface 160 when first sheet 250 is in the first position of FIG. 6. Similarly, a portion of a third surface 830 of second sheet portion 252 can be seen contacting a portion of second article 244.

As first sheet 250 is pulled further forward toward third side 106 in FIG. 9, receptacle 150 can function as a secondary hinge region. When first sheet 250 presses against receptacle 150, it can deform in some embodiments and assume a fourth position. In other words, as first sheet 250 is pulled forward toward third side 106, in one embodiment, receptacle 150 can help redirect the curvature of at least a portion of first sheet 250, such that its angle of translation changes. As a result of the flexibility of the material comprising first sheet 250, and as a pulling force is exerted on first sheet 250, first sheet portion 252 begins to wrap around a portion of first article 242, and second sheet portion 254 begins to wrap around a portion of second article 244. Thus, in some embodiments, first sheet 250 can bend, curve, deform, or otherwise flex to at least partially accommodate the shape of receptacle 150.

Figure 10:
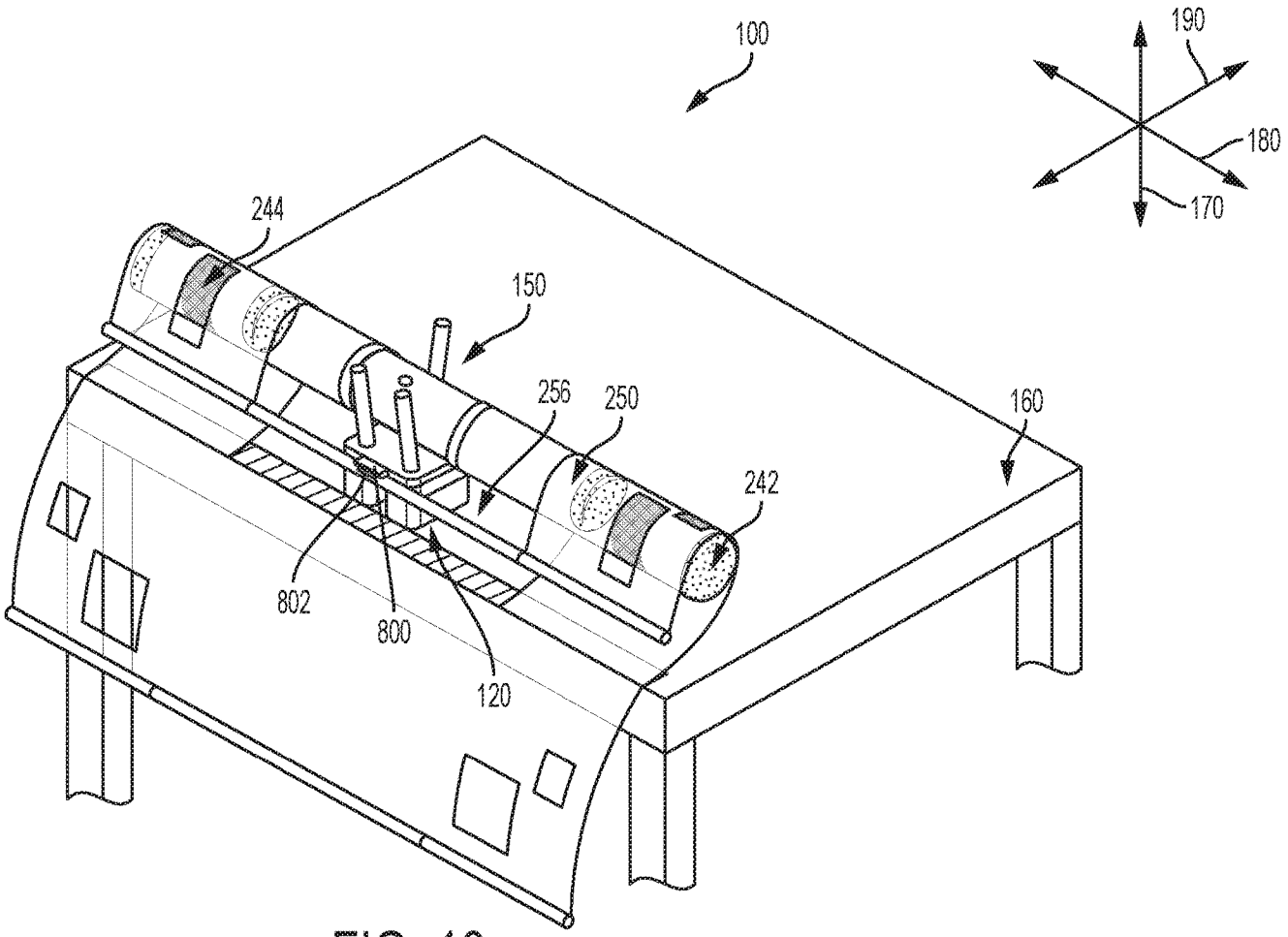
FIG. 10 is a schematic view of an embodiment of the use of the alignment system and a securing provision.

As shown in FIG. 10, in some embodiments, first sheet 250 can continue to be moved such that it wraps more fully over and around receptacle 150, assuming a fifth position. In the fifth position, first sheet 250 can be substantially curved and extend in a looping fashion around receptacle 150. It can be seen in FIGS. 8-10 that in some embodiments, the opening between first sheet portion 252 and second sheet portion 254 that comprises first gap 256 can help accommodate receiving assembly 110 when first sheet 250 is curved toward third side 106. In one embodiment, first gap 256 can be configured to have a size and/or shape that may specifically accommodate the components associated with base portion 120. Thus, first sheet portion 252, second sheet portion 254, and first support member 258 of first sheet 250 are able to translate substantially over and around receptacle 150 without interference or obstruction from receiving assembly 110.

In different embodiments, alignment system 100 may include provisions for maintaining first sheet 250 in the fifth position of FIG. 10 for an extended period of time. In some embodiments, alignment system 100 may include a retaining or locking system. In one embodiment, alignment system 100 may include a positive locking system, for example. Thus, in one embodiment, first sheet 250 can be fixed in position relative to the receiving base while also being configured to curve and extend around at least a portion of the circumference of receptacle 150.

In some embodiments, a portion of a supporting member of a sheet may be joined and secured to a portion of the base portion. Thus, in some cases, there may be retaining elements disposed along components of alignment system 100. In some embodiments, a retaining element may be a material or element joined to a portion of alignment system 100 that allows users to clip, buckle, attach, detach, connect or otherwise securely attach one region of a sheet to a region of receiving assembly 110, while also allowing the user to readily detach the two regions. In some embodiments, the component may be an independent element. In different embodiments, the retaining elements may comprise a buckle, loop, button, releasable catch, ring, magnetic contact, snaps, a zipper, a hook-and-loop closure system such as Velcro, or other element providing a point of anchor or attachment to a portion of securing members 140. The retaining element may be made of any material, including textiles, or more rigid materials such as plastic or a metal material. In one embodiment, the retaining element may comprise a first part and a second part. In some cases, the first part may be configured to join with or connect to the second part. In some cases, the positive locking system may comprise a pair of attractive (i.e., magnetic) elements that can help to removably attach part of the base portion with a part of the support member of a flexible sheet.

Referring back to FIG. 8, base portion 120 can be seen to include at least a first retaining element 800 in some embodiments. Furthermore, in some embodiments, one or more support members of sheets 132 may include at least one corresponding second retaining element 802. As shown in FIG. 9, in some embodiments, when first support member 258 contacts or presses against base portion 120, second retaining element 802 of first support member 258 and first retaining member 800 of base portion 120 can align and/or lock together. For example, first retaining element 800 associated with base portion 120 may contact second retaining element 802 associated with first support member 258 in order to connect or secure the two elements together. In one embodiment, this may occur through a magnetic locking system. Other embodiments with different types or number of retaining elements may include only one locking portion, or more than two locking portions.

Figure 11:
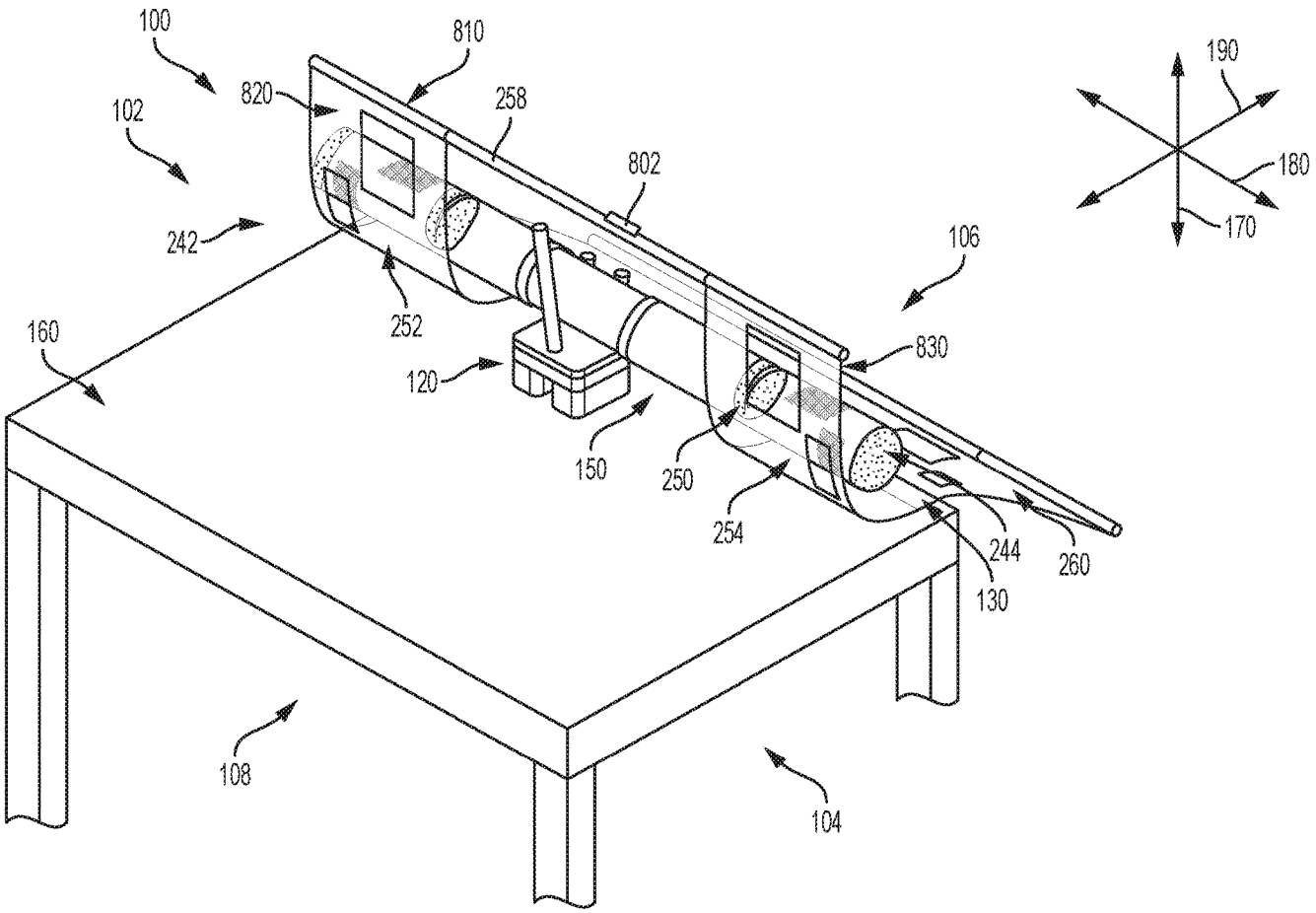
FIG. 11 is a schematic view of an embodiment of a flexible sheet and a receptacle device.

Referring now to FIG. 11, a rear isometric view (illustrated from the perspective of fourth side 108) is also depicted for purposes of providing the reader with a better understanding of the embodiments described herein. In FIG. 11, it can be seen that first sheet 250 is in a position similar to the third position of first sheet 250 that was depicted in FIG. 8. In other words, first sheet 250 is being shown as it deforms and extends toward receptacle 150. A portion of first surface 810 of first sheet portion 252 is facing a portion of first article 242. Similarly, a portion of third surface 830 of second sheet portion 252 can be seen facing toward a portion of second article 244.

Figure 14:
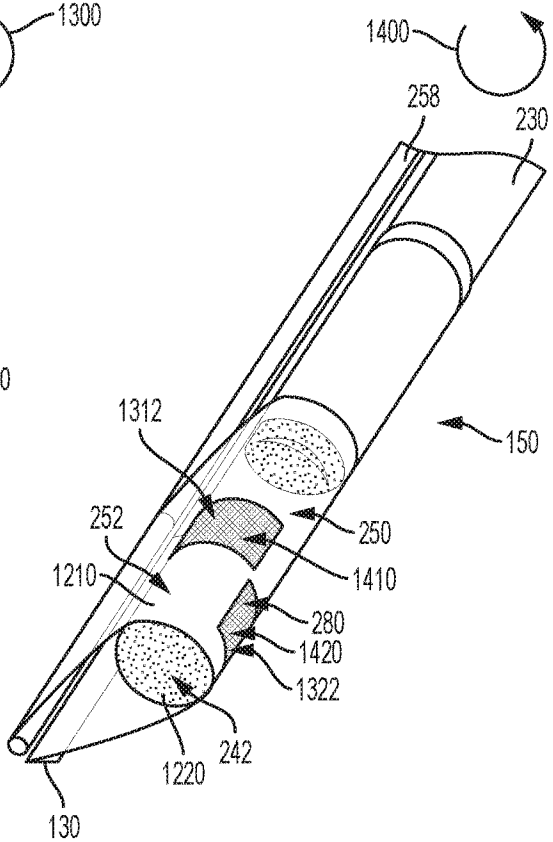
FIG. 14 is a schematic view of an embodiment of a flexible sheet and an article of apparel.
Figure 13:
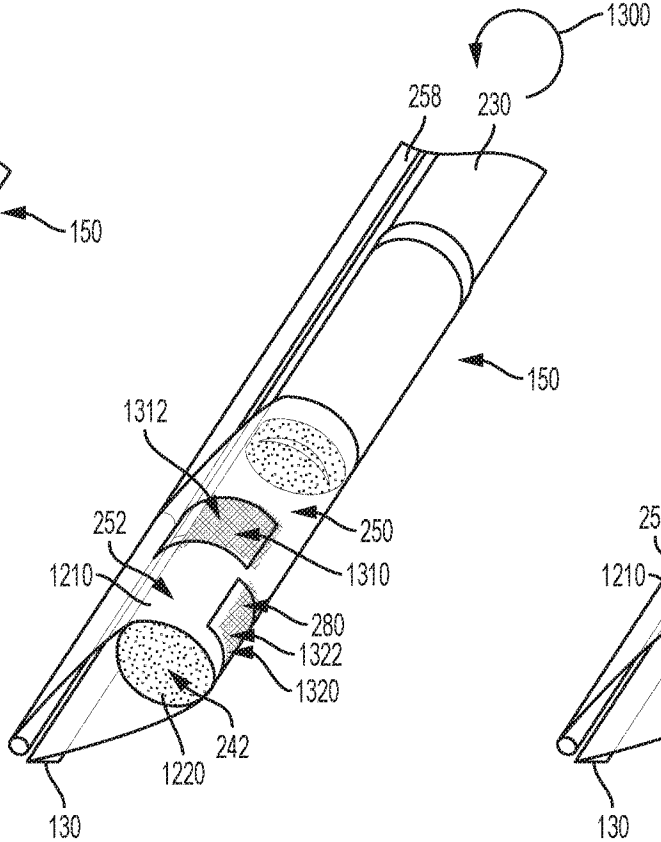
FIG. 13 is a schematic view of an embodiment of a flexible sheet and a receptacle device.
Figure 12:
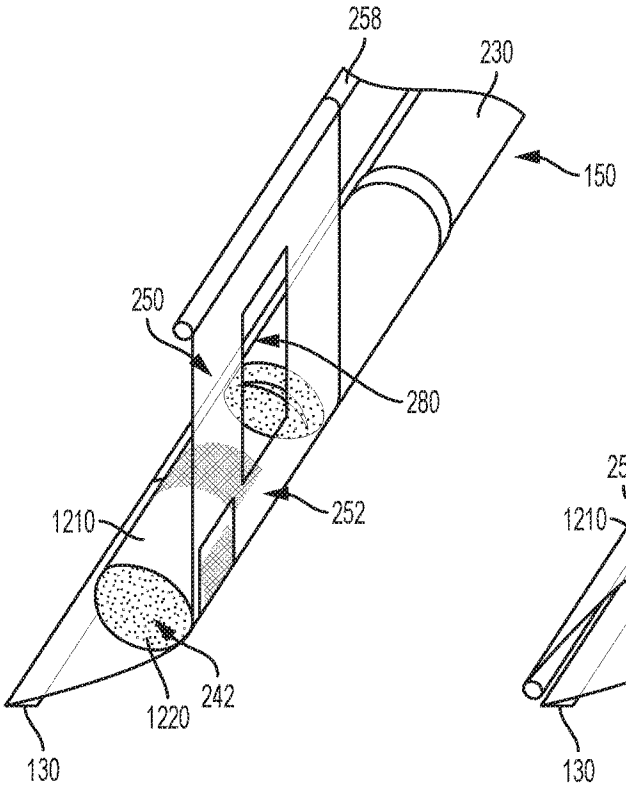
FIG. 12 is a schematic view of an embodiment of a flexible sheet and a receptacle device.

In order to provide the reader with further details regarding the use of alignment system 100, FIGS. 12-14 depict a series of side isometric views (from the perspective of first side 102) of receptacle 150. Only a portion of alignment system 100 is shown in these figures for purposes of clarity. FIG. 12 provides a view of an embodiment of first sheet 250 in its third position (see FIG. 8), as it contacts receptacle 150. FIG. 13 provides a view of first sheet 250 as it is moved in a counterclockwise direction 1300 to assume the fifth position (see FIG. 10), further deforming and wrapping more substantially over receptacle 150.

In FIGS. 12 and 13, it can be seen that the circumferential position and orientation of receptacle 150 in the receiving assembly, as well as the placement of an article over receptacle 150, can determine how the various apertures 280 of first sheet 250 align with an article. As first sheet 250 curves and extends over receptacle 150, apertures 280 formed in first sheet 250 may correspond to and/or define various portions of an article that remain exposed. In FIG. 13, first sheet 250 is substantially wrapped over receptacle 150, and first sheet portion 252 has curved to accommodate at least a portion of first article 242. In some embodiments, apertures 280 of first sheet portion 252 can include a first aperture 1312 and a second aperture 1322. In FIG. 13, a first portion 1310 of first article 242 is exposed through first aperture 1312, and a second portion 1320 of first article 242 is exposed through second aperture 1322. It should be understood that in some embodiments, during use of alignment system 100, even when a flexible sheet has been wrapped around receptacle 150, there may be portions of articles that remain exposed.

In some embodiments, it may be desired to align apertures 280 with specific predetermined portions of an article. As shown in FIG. 14, an article may be adjusted while it is loaded on receptacle 150 to bring a desired portion of the article into alignment with one or more of apertures 280 in some embodiments. For example, by changing the relative position of first article 242 with respect to receptacle 150, the portions of the article corresponding to any apertures can be changed. In FIG. 14, first article 242 has been shifted along receptacle 150 in a direction generally represented by an arrow 1400, such that first aperture 1312 is now aligned with and exposes a first reference portion 1410 of first article 250, and second aperture 1322 is aligned with and exposes a second reference portion 1420 of first article 250.

In other words, in some embodiments, while an aperture may be initially associated with a first portion of an article, by adjusting the arrangement or disposition of the article and/or the sheet, the aperture may be disposed in a location that is adjacent to a specific predetermined region, or reference region, associated with the article. In some cases, this region can correspond to regions of the article where the user would like the printed material to be excluded (or, in some cases, where the user would like the printed material to be included). However, in other embodiments, the reference region can be a visual indicator on the article that does not necessarily correspond to a region where printing is to occur or is to be excluded.

Thus, in some embodiments, an article may include various "article reference regions" that can guide the alignment process of the article with the receptacle. In one embodiment, the alignment of the article with the receptacle can be inferred by the alignment of the article reference regions with the one or more reference markers of the flexible sheets. This can be facilitated by the fact that, as noted above, the receptacle can be fixed in a specific circumferential position or orientation in the receiving area of the base portion. Furthermore, because the flexible sheets can be fixed with respect to the base portion through attachment to the anchor portion, the alignment of the entire article with the receptacle can be extrapolated by the alignment of the article reference regions with the one or more reference markers of the flexible sheets in different embodiments.

For example, in the embodiments illustrated in the Figures, the articles are depicted as socks. Thus, in one embodiment, a sock may include differently colored or marked areas (article reference regions or reference portions) that can be used to align the sock with or on the receptacle. The correct alignment of the sock (or any other article of apparel) on the receptacle can allow one or more specific portions of the article to be excluded from (or included in) printing in a subsequent step, depending, for example, on the nature of the printed design and the desired goal of the user. While the embodiments herein will generally describe the article reference regions as regions comprising different coloring or markings, it should be understood that in other embodiments, the article reference regions may comprise any other type of marking, such as indicators, symbols, characters, images, lines, or other graphics disposed along the surface of the articles. Furthermore, variations in texturing (such as ribbing, dimpling, or changes in thickness or material) can be used to indicate article reference regions in some embodiments. Thus, for purposes of this disclosure, article reference regions refer to any marking or reference indicator associated with an article of apparel that is configured to help align at least a portion of the article of apparel with the receptacle.

In different embodiments, to align an article for use in a printing system, the flexible sheets can include "sheet reference markers." As discussed above, in some embodiments, sheet reference markers can comprise of one or more apertures that may match or correspond to one or more article reference regions. The sheet reference markers may be arranged on the sheets to help align the article into the correct position on the receptacle. Once the article is correctly positioned and the article reference regions are aligned with their respective sheet reference markers, the receptacle and article(s) can be moved to a printing system where printed material can be applied to the appropriate or desired regions of the article (see FIG. 22). While the embodiments herein describe the sheet reference markers as apertures, it should be understood that in other embodiments, the sheet reference markers may comprise any other type of marking, such as indicators, symbols, characters, images, lines, or other graphics disposed along the surface of the sheets. Thus, for purposes of this disclosure, sheet reference markers refer to any marking or reference indicator associated with a flexible sheet that is configured to help align at least a portion of an article of apparel on or with the receptacle.

In different embodiments, the sheet reference markers can align with visual reference points on the article. In some embodiments, once the receptacle is fixed in a specific alignment with the base portion, the flexible sheet can be positioned over the receptacle. In some cases, this will occur so a correct alignment of the article of apparel with the receptacle may be inferred by the alignment of the article's reference regions with the reference markers of the flexible sheet.

In some embodiments, in order to fully align an aperture with a reference region on the article, the position and/or orientation of the aperture may be adjusted. In other embodiments, the position of an article loaded on the receptacle can be adjusted until it is properly aligned (such that the reference region(s) of the article is aligned with the aperture(s)). It should be understood that in some embodiments, the position of an article reference region relative to a sheet reference marker could also be adjusted by moving receptacle 150 or another component of alignment system 100. In other words, the alignment of apertures 280 on an article may be accomplished by adjusting the relative positions of first sheet 250 and first article 242 in any manner.

Referring to FIGS. 12-14, it can also be noted that, in different embodiments, the flexible sheets may curve and extend around a substantial area of outer surface 230 while outer surface 230 is in contact with and/or receiving one or more articles. In other words, a flexible sheet may be deformed such that it wraps over and around a large proportion of the curved surface area associated with outer surface 230. Thus, a portion of an article may be sandwiched or layered between a flexible sheet and the outer surface of receptacle 150. For purposes of convenience, in some embodiments, outer surface 230 can be demarcated into an upper region 1210 and a lower region 1220. Upper region 1210 may generally represent the upper half portion of the receptacle's outer surface 230, and lower region 1220 may generally represent the lower half portion of the receptacle's outer surface 230 when receptacle 150 is positioned on the receiving assembly. While an article is directly mounted on and contacts outer surface 230 of receptacle 150, it should be understood that the flexible sheets may be curved around receptacle 150 to generally match a corresponding curvature of outer surface 230 of receptacle 150. In some embodiments, first sheet 250 can be configured to curve and extend around different regions of receptacle 150. For example, as shown in FIGS. 12-14, first sheet 250 can be configured to curve and extend around at least a portion of lower region 1220 of receptacle 150 or at least a portion of upper region 1210 of receptacle 150 when receptacle 150 is disposed in the receiving base. In one embodiment, first sheet 250 can curve and extend around at least a portion of lower region 1220 and upper region 1210 of receptacle 150. In some cases, first sheet 250 can curve and extend around a substantial majority of upper region 1210 of outer surface 230 of receptacle 150. In other cases, first sheet 250 can curve and extend around a substantial majority of lower region 1220 of outer surface 230 of receptacle 150. In some cases, first sheet 250 can curve and extend around a substantial majority of both upper region 1210 and lower region 1220 of outer surface 230 of receptacle 150.

In different embodiments, once a flexible sheet has been deformed to the extent that it substantially curves around receptacle 150 (and is optionally locked into its position), further alignment steps may occur, as noted above with respect to FIG. 14. In embodiments where receptacle includes both a first article and a second article, each article may be adjusted on the receptacle in order to align with apertures 280 of the flexible sheet portions with specific article reference regions associated with the two articles.

Figures 15, 16, 17:
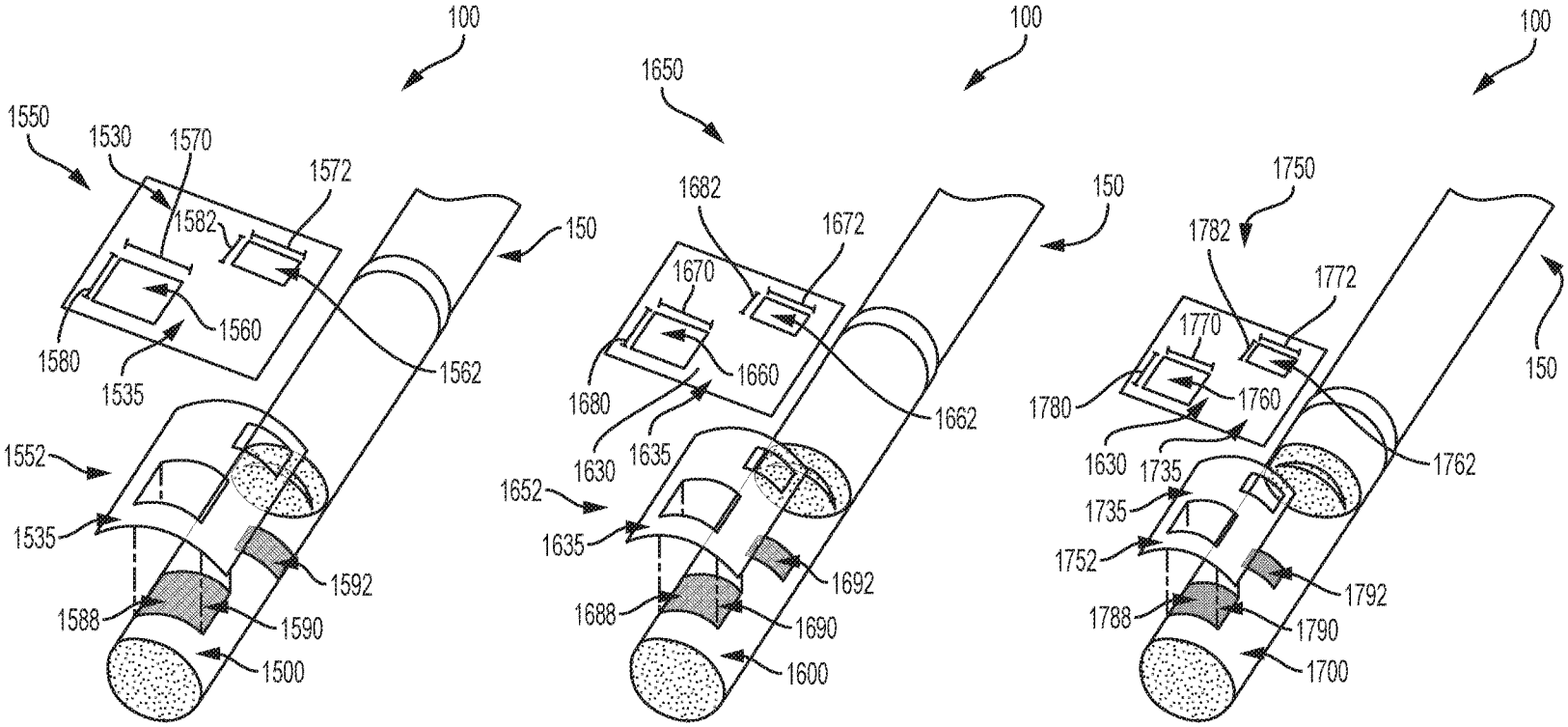
FIG. 15 is a schematic view of an embodiment of a flexible sheet and an article of apparel.
FIG. 16 is a schematic view of an embodiment of a flexible sheet and an article of apparel.
FIG. 17 is a schematic view of an embodiment of a flexible sheet and an article of apparel.

In some embodiments, different sheet portions may be designed or manufactured to accommodate articles of varying sizes. In some cases, a specific sheet portion (or an entire sheet) may be used as an alignment reference for a specific article size. FIGS. 15-17 illustrate a few examples of the variety of article sizes that may be aligned using alignment system 100. In a first example shown in FIG. 15, a portion of alignment system 100 is illustrated, including receptacle 150 loaded with a third article 1500. A portion of a third sheet 1530 comprising at least a fifth sheet portion 1535 is depicted above receptacle 150. For purposes of illustration, two representations of third sheet 1530 are included, depicting two states or configurations of third sheet 1530. A first state 1550 represents the flattened configuration (similar to the first position of first sheet 250 as shown in FIG. 6) of third sheet 1530, and a second state 1552 represents a deformed or curved configuration of third sheet 1530.

First state 1550 shows the general boundaries of a first aperture 1560 and a second aperture 1562 disposed along fifth sheet portion 1535 of third sheet 1530. As noted above, in different embodiments, each aperture may comprise varying dimensions and shapes. In FIG. 15, first aperture 1560 and second aperture 1562 each have a perimeter with a generally rectangular shape. Furthermore, first aperture 1560 includes a first length 1570 and a first width 1580. Second aperture 1562 includes a second length 1572 and a second width 1582. In some embodiments, the lengths and/or widths (and other relevant dimensions) associated with the apertures disposed in a single sheet portion may be substantially similar. In other embodiments, the dimensions between two or more apertures may differ. Furthermore, in other embodiments, there may be fewer apertures, or a greater number of apertures.

For example, in FIG. 15, first length 1570 is greater than second length 1572. In addition, first width 1580 is greater than second width 1582. Thus, it can also be seen that the area associated with first aperture 1560 is generally larger than the area associated with second aperture 1562. However, it should be understood that in other embodiments, first length 1570 may be substantially similar to or less than second length 1572. Similarly, first width 1580 may be substantially similar to or less than second width 1582 in different embodiments.

As stated above, in some embodiments, one sheet portion may be sized or configured to provide an alignment reference for an article of a particular size. For example, fifth sheet portion 1535 may be configured for use with third article 1500, which has a first standard size. For purposes of this disclosure, a standard size refers to the alphanumerical indication of the fitting size of an article for a person. In embodiments where the article represents a sock for example, this generally consists of a number indicating the approximate length of a portion of the article, and/or the footwear size for which the article is intended to be worn with.

Thus, a sheet may include one or more apertures that are specifically configured to correspond with one or more reference regions 1588 associated with a particular article size. In FIG. 15, reference regions 1588 include a first reference region 1590 and a second reference region 1592. To better illustrate the alignment that can occur or be arranged between a sheet and an article, an example of the alignment between the apertures of fifth sheet portion 1535 (in deformed second state 1552) and reference regions 1588 is depicted using dotted lines. It can be seen that the area and shape associated with first reference region 1590 is substantially similar to the area and shape associated with first aperture 1560. Furthermore, the area and shape associated with second reference region 1592 is substantially similar to the area and shape associated with second aperture 1562. In other words, in some embodiments, third sheet 1530 can be configured such that when third sheet 1530 contacts a particular article having a specific size, the sheet reference marker(s) can become substantially aligned with the article reference regions. In some embodiments, some adjustment of the position of the article on receptacle 150 may be needed to improve and/or "hone" the alignment between the sheet reference markers and the article reference regions. Thus, it can be understood that a flexible sheet may be configured (or manufactured) for use with a specific article size or article type, such that the reference markers of the sheet correspond with the reference regions of the article.

Figure 3:
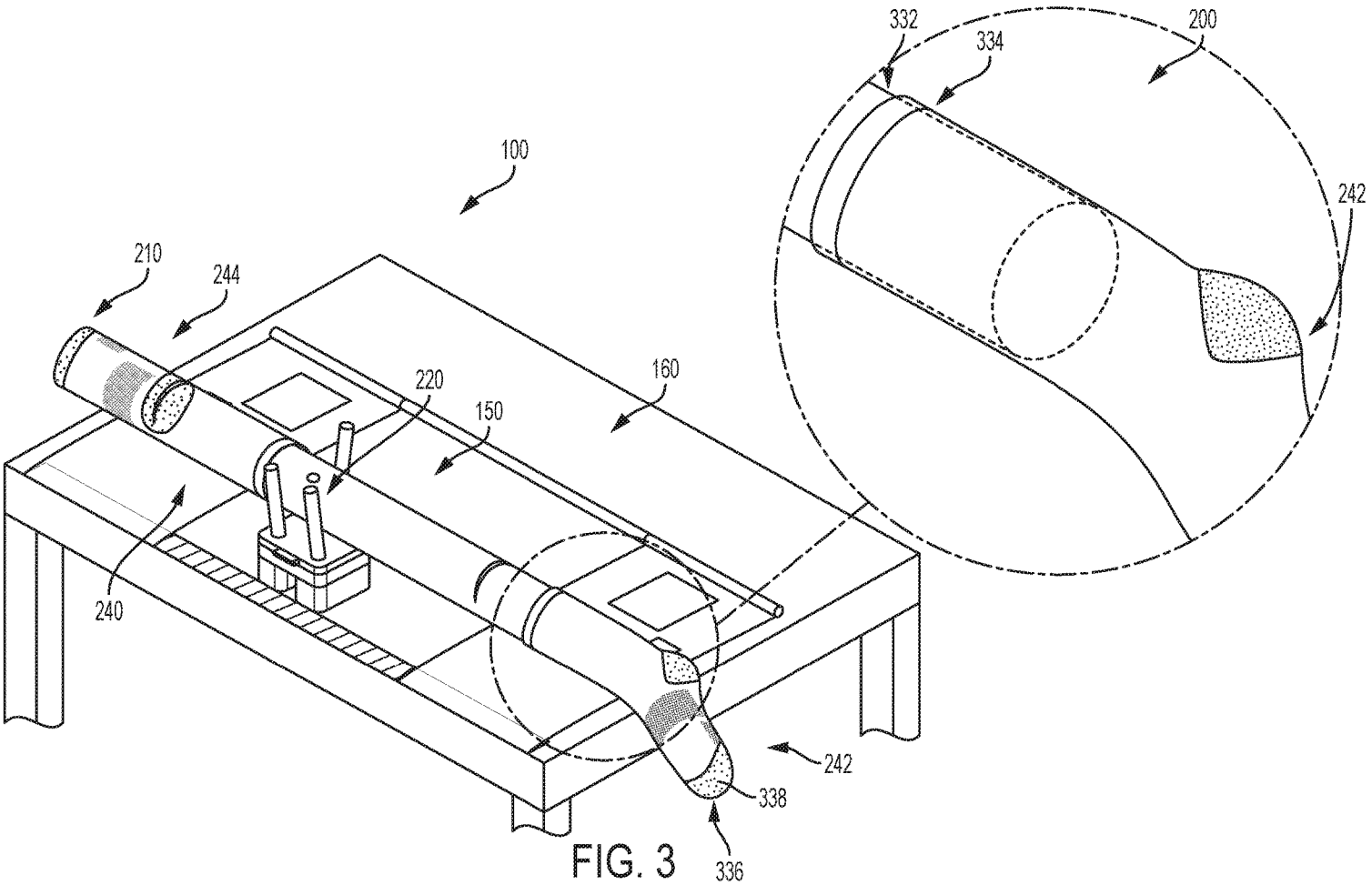
FIG. 3 is a schematic view of an article of apparel being placed onto a receptacle device.

In different embodiments, as described above, another sheet or sheet portion may be designed or manufactured to accommodate or align with article reference regions of another size (as discussed with respect to FIGS. 3 and 4 above). In some cases, a specific sheet portion (or sheet) may be used as an alignment reference for a specific article size. For example, in FIG. 16, a portion of alignment system 100 is illustrated, including receptacle 150 loaded with a fourth article 1600. A portion of a fourth sheet 1630 comprising at least a sixth sheet portion 1635 is depicted above receptacle 150. For purposes of illustration, two representations of fourth sheet 1630 are included, depicting two states or configurations of fourth sheet 1630. A first state 1650 represents the flattened configuration (similar to the first position of first sheet 250 in FIG. 6) of fourth sheet 1630, and a second state 1652 represents a deformed or curved configuration of fourth sheet 1630.

First state 1650 shows the general boundaries of a third aperture 1660 and a fourth aperture 1662 disposed along sixth sheet portion 1635 of fourth sheet 1630. As noted above, in different embodiments, each aperture may comprise varying dimensions and shapes. In FIG. 16, third aperture 1660 and fourth aperture 1662 each have a perimeter with a generally rectangular shape. Furthermore, third aperture 1660 includes a third length 1670 and a third width 1680. Fourth aperture 1662 includes a fourth length 1672 and a fourth width 1682. In some embodiments, the lengths and/or widths (and other relevant dimensions) associated with the apertures disposed in a single sheet portion may be substantially similar. In other embodiments, the dimensions between two or more apertures may differ. Furthermore, in other embodiments, there may be fewer apertures, or a greater number of apertures.

For example, in FIG. 16, third length 1670 is greater than fourth length 1672. In addition, third width 1680 is greater than fourth width 1682. Thus, it can also be seen that the area associated with third aperture 1660 is larger than the area associated with fourth aperture 1662. However, it should be understood that in other embodiments, third length 1670 may be substantially similar to or less than fourth length 1672. Similarly, third width 1680 may be substantially similar to or less than fourth width 1682 in different embodiments.

Furthermore, referring to FIGS. 15 and 16, in some embodiments, the sheet reference markers associated with fourth sheet 1630 (comprising third aperture 1660 and fourth aperture 1662) may differ from the sheet reference markers associated with third sheet 1530 (comprising first aperture 1560 and second aperture 1562). In some embodiments, there may be a greater number or a fewer number of apertures in third sheet 1530 relative to fourth sheet 1630. In another embodiment, the relative position of one or more apertures along third sheet 1530 may differ from the relative position of one or more apertures along fourth sheet 1630. However, in some embodiments, there may be similarly situated apertures and/or the same number of apertures between two or more flexible sheets.

In addition, in some embodiments, the dimensions of apertures across different sheets can vary. As noted above, each aperture may be associated with different shapes or areas. For example, third length 1670 of third aperture 1660 is greater than first length 1570 of first aperture 1560. Furthermore, third width 1680 of third aperture 1660 is greater than first width 1580 of first aperture 1560. Thus, it can also be seen that the area associated with third aperture 1660 is larger than the area associated with first aperture 1560. In another example, fourth length 1672 of fourth aperture 1662 is greater than second length 1572 of second aperture 1562. Furthermore, fourth width 1682 of fourth aperture 1662 is greater than second width 1582 of second aperture 1562. Thus, it can also be seen that the area associated with fourth aperture 1662 is larger than the area associated with second aperture 1562. Thus, in some embodiments, for example embodiments where there are the same number of apertures between two or more flexible sheets (as shown in FIGS. 15 and 16), the apertures may be differently sized. The apertures or other sheet reference markers may be configured to accommodate article reference regions associated with differently sized articles in some embodiments. However, it should be understood that in other embodiments, third length 1670 may be substantially similar to or less than first length 1570, and third width 1680 may be substantially similar to or less than first width 1580. Similarly, fourth length 1672 may be substantially similar to or less than second length 1572, and fourth width 1682 may be substantially similar to or less than second width 1582 in other embodiments.

Thus, in some embodiments, one sheet portion may be designed to provide an alignment reference for an article of a particular size. For example, sixth sheet portion 1635 may be configured for use with fourth article 1600, which has a second standard size. Referring to FIGS. 15 and 16, it should be understood that the first standard size of FIG. 15 is smaller than the second standard size of FIG. 16. In some embodiments, a sheet may include one or more apertures that are specifically configured to correspond with one or more reference regions for a particular article size. In FIG. 16, reference regions 1688 include a third reference region 1690 and a fourth reference region 1692. To better illustrate the alignment that can occur or be arranged between a sheet and an article, an example of the alignment between the apertures of sixth sheet portion 1635 (in deformed second state 1652) and reference regions 1688 is depicted using dotted lines. It can be seen that the area and shape associated with third reference region 1690 is substantially similar to the area and shape associated with third aperture 1660. Furthermore, the area and shape associated with fourth reference region 1692 is substantially similar to the area and shape associated with fourth aperture 1662. In other words, in some embodiments, fourth sheet 1630 can be configured such that when fourth sheet 1630 contacts a particular article (here an article with a second standard size), the sheet reference marker(s) can be substantially aligned with the article reference region(s). In some embodiments, some adjustment of the position of the article relative to receptacle 150 may be needed to improve and/or "hone" the alignment between the sheet reference markers and the article reference regions. Thus, it can be again understood that a flexible sheet may be configured (or manufactured) for use with a specific article size or article type, such that the reference markers of the sheet correspond with the reference regions of the article.

In different embodiments, as described above, another flexible sheet or sheet portion may be designed or manufactured to accommodate or align with article reference regions of another size (as discussed with respect to FIGS. 3 and 4 above). In some cases, a specific sheet portion (or sheet) may be used as an alignment reference for an article with a smaller or larger size. For example, in FIG. 17, a portion of alignment system 100 is illustrated, including receptacle 150 loaded with a fifth article 1700. A portion of a fifth sheet 1730 comprising at least a seventh sheet portion 1735 is depicted above receptacle 150. For purposes of illustration, two representations of fifth sheet 1730 are included, depicting two states or configurations of fifth sheet 1730. A first state 1750 represents the flattened configuration (similar to the first position of first sheet 250 in FIG. 6) of fifth sheet 1730, and a second state 1752 represents a deformed or curved configuration of fifth sheet 1730.

First state 1750 shows the general boundaries of a fifth aperture 1760 and a sixth aperture 1762 disposed along seventh sheet portion 1735 of fifth sheet 1730. As noted above, in different embodiments, each aperture may comprise varying dimensions and shapes. In FIG. 17, fifth aperture 1760 and sixth aperture 1762 each have a perimeter with a generally rectangular shape. Furthermore, fifth aperture 1760 includes a fifth length 1770 and a fifth width 1780. Sixth aperture 1762 includes a sixth length 1772 and a sixth width 1782. As mentioned above, in some embodiments, the lengths and/or widths (and other relevant dimensions) associated with the apertures disposed in a single sheet portion may be substantially similar. In other embodiments, the dimensions between two or more apertures may differ. Furthermore, in other embodiments, there may be fewer apertures, or a greater number of apertures.

For example, in FIG. 17, fifth length 1770 is greater than sixth length 1772. In addition, fifth width 1780 is greater than sixth width 1782. Thus, it can also be seen that the area associated with fifth aperture 1760 is larger than the area associated with sixth aperture 1762. However, it should be understood that in other embodiments, fifth length 1770 may be substantially similar to or less than sixth length 1772. Similarly, fifth width 1780 may be substantially similar to or less than sixth width 1782 in different embodiments.

Furthermore, referring to FIGS. 15-17, in some embodiments, the sheet reference markers associated with fifth sheet 1730 (comprising fifth aperture 1760 and sixth aperture 1762) may differ from the sheet reference markers associated with fourth sheet 1630 (comprising third aperture 1660 and fourth aperture 1662) and/or third sheet 1530 (comprising first aperture 1560 and second aperture 1562). In some embodiments, there may be a greater number or a fewer number of apertures in fourth sheet 1630 and/or third sheet 1530 relative to fifth sheet 1730. In another embodiment, the relative position of one or more apertures along fourth sheet 1630 and/or third sheet 1530 may differ from the relative position of one or more apertures along fifth sheet 1730. However, in some embodiments, there may be similarly situated apertures and/or the same number of apertures between two or more flexible sheets.

In addition, in some embodiments, the dimensions of apertures across different sheets can vary. As noted above, each aperture may be associated with different shapes or areas. For example, fifth length 1770 of fifth aperture 1760 is greater than third length 1670 of third aperture 1660. Furthermore, fifth width 1780 of fifth aperture 1760 is greater than third width 1680 of third aperture 1660. Thus, it can be seen that the area associated with fifth aperture 1760 is larger than the area associated with third aperture 1660. In another example, sixth length 1772 of sixth aperture 1762 is greater than fourth length 1672 of fourth aperture 1662. Furthermore, sixth width 1782 of sixth aperture 1762 is greater than fourth width 1682 of fourth aperture 1662. Thus, it can also be seen that the area associated with sixth aperture 1762 is larger than the area associated with fourth aperture 1662. Thus, in some embodiments, for example embodiments where there are the same number of apertures between two or more flexible sheets (as shown in FIGS. 16 and 17), the apertures may be differently sized. The apertures or other sheet reference markers may be adjusted in order to accommodate article reference regions associated with differently sized articles in some embodiments. However, it should be understood that in other embodiments, fifth length 1770 may be substantially similar to or less than third length 1670, and fifth width 1780 may be substantially similar to or less than third width 1680. Similarly, sixth length 1772 may be substantially similar to or less than fourth length 1672, and sixth width 1782 may be substantially similar to or less than fourth width 1682 in other embodiments.

Thus, in some embodiments, one sheet portion may be designed to provide an alignment reference for an article of a particular size. For example, seventh sheet portion 1735 may be configured for use with fifth article 1700, which has a third standard size. Referring to FIGS. 16 and 17, it should be understood that the second standard size of FIG. 16 is smaller than the third standard size of FIG. 17. In some embodiments, a sheet may include one or more apertures that are specifically configured to correspond with one or more reference regions for a particular article size. In FIG. 17, reference regions 1788 include a fifth reference region 1790 and a sixth reference region 1792. To better illustrate the alignment that can occur or be arranged between a sheet and an article, an example of the alignment between the apertures of seventh sheet portion 1735 (in deformed second state 1752) and reference regions 1788 is depicted using dotted lines. It can be seen that the area and shape associated with fifth reference region 1790 is substantially similar to the area and shape associated with fifth aperture 1760. Furthermore, the area and shape associated with sixth reference region 1792 is substantially similar to the area and shape associated with sixth aperture 1762. In other words, in some embodiments, fifth sheet 1730 can be configured such that when fifth sheet 1730 contacts a particular article (here an article with a third standard size), the sheet reference marker(s) can be substantially aligned with the article reference region(s). In some embodiments, some adjustment of the position of the article relative to receptacle 150 may be needed to improve and/or "hone" the alignment between the sheet reference markers and the article reference regions. Thus, a flexible sheet may be configured (or manufactured) for use with a specific article size or article type, such that the reference markers of the sheet correspond with the reference regions of the article.

As noted above, in some embodiments, different sheet portions may be designed or manufactured to accommodate articles of varying types. For purposes of this disclosure, an "article type" refers to an article configured for use for a specific activities or individual preference. In one embodiment, two different article types can refer to two types of socks that are designed for use in two different sports (e.g., soccer, basketball, football, hockey, water sports, hiking, running, walking, lacrosse, or other activities). Thus, in one case, a first sock can be configured for use in a first activity, and a second sock can be configured for use in a second activity that differs from the first activity. In other embodiments, two different article types can refer to two or more socks with different material compositions, texturing, elasticity, thickness, and/or other properties. It should be understood that articles of apparel other than socks may also be utilized by the alignment system described herein and comprise different "article types" (such as booties, gloves, thermal coverings, tubular fabrics, etc.).

In some embodiments, a first article type may include article reference regions that differ from the article reference regions associated with a second article type. In different embodiments, a specific sheet portion (or sheet) may provide an alignment reference for a specific article type. For example, in FIG. 18, a portion of alignment system 100 is illustrated, including receptacle 150 loaded with a sixth article 1800. A portion of a sixth sheet 1830 comprising at least a seventh sheet portion 1835 is depicted above receptacle 150. For purposes of illustration, two examples of sixth sheet 1830 are included, representing two states or configurations of sixth sheet 1830. A first state 1850 represents the flattened configuration (similar to the first position of first sheet 250 in FIG. 6) of sixth sheet 1830, and a second state 1852 represents a deformed or curved configuration of sixth sheet 1830.

Figures 18, 19, 20:
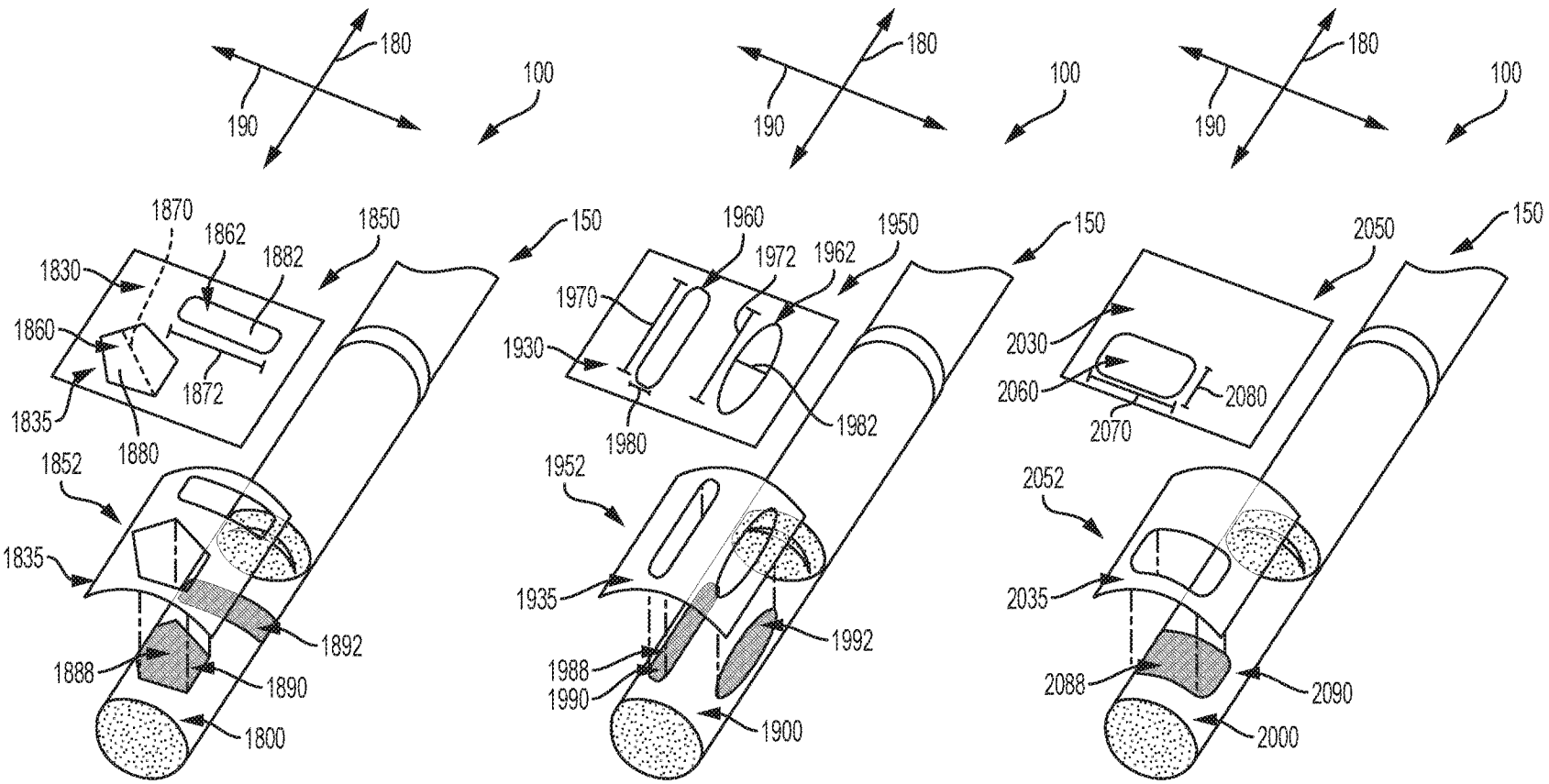
FIG. 18 is a schematic view of an embodiment of a flexible sheet and an article of apparel.
FIG. 19 is a schematic view of an embodiment of a flexible sheet and an article of apparel.
FIG. 20 is a schematic view of an embodiment of a flexible sheet and an article of apparel.

First state 1850 illustrates the general boundaries of a seventh aperture 1860 and an eighth aperture 1862 disposed along seventh sheet portion 1835 of sixth sheet 1830. As noted above, in different embodiments, each aperture may comprise varying dimensions and shapes. In FIG. 18, seventh aperture 1860 has a perimeter with a generally pentagonal shape, and eighth aperture 1862 has a perimeter with a generally oblong rectangular shape. Thus, apertures may comprise varying geometries in different embodiments.

Furthermore, seventh aperture 1860 includes a seventh length 1870, associated with the maximum length across seventh aperture 1860 extending in a direction substantially aligned with lateral axis 190 and a seventh area 1880. Eighth aperture 1862 includes an eighth length 1872, associated with the maximum length across eighth aperture 1862 extending in a direction substantially aligned with lateral axis 190 and an eighth area 1882. In some embodiments, the size (and other relevant dimensions) associated with the apertures disposed in a single sheet portion may be substantially similar. In other embodiments, the dimensions between two or more apertures may differ. Furthermore, in other embodiments, there may be fewer apertures, or a greater number of apertures.

For example, in FIG. 18, seventh length 1870 is greater than eighth length 1872. In addition, seventh area 1880 is greater than eighth area 1882. However, it should be understood that in other embodiments, seventh length 1870 may be substantially similar to or less than eighth length 1872. Similarly, seventh area 1880 may be substantially similar to or less than eighth area 1882 in different embodiments.

As stated above, in some embodiments, one sheet portion may be sized or otherwise configured to provide an alignment reference for an article of a particular type. For example, eighth sheet portion 1835 may be configured for use with sixth article 1800, which may be designed for a first athletic activity. Thus, a sheet may include one or more apertures that are specifically configured to correspond with one or more reference regions for a particular article type. In FIG. 18, reference regions 1888 include a seventh reference region 1890 and an eighth reference region 1892. To better illustrate the alignment that can occur or be arranged between a sheet and an article, an example of the alignment between the apertures of seventh sheet portion 1835 (in deformed second state 1852) and reference regions 1888 is depicted using dotted lines. It can be seen that the area and shape associated with seventh reference region 1890 is substantially similar to the area and shape associated with seventh aperture 1860. Furthermore, the area and shape associated with eighth reference region 1892 is substantially similar to the area and shape associated with eighth aperture 1862. In other words, in some embodiments, sixth sheet 1830 can be configured such that when sixth sheet 1830 contacts a particular article, the sheet reference marker(s) can be substantially aligned with the article reference regions. In some embodiments, some adjustment of the position of the article on receptacle 150 may be needed to improve and/or "hone" the alignment between the sheet reference markers and the article reference regions. Thus, it can be understood that a flexible sheet may be configured (or manufactured) for use with a specific article size or article type, such that the reference markers of the sheet correspond with the reference regions of the article.

In different embodiments, as described above, another sheet or sheet portion may be designed or manufactured to accommodate or align with article reference regions of another article type (as discussed with respect to FIGS. 3 and 4 above). In some cases, a specific sheet portion (or sheet) may be used as an alignment reference for a specific article type or an article with a substantially different pattern of reference regions. For example, in FIG. 19, a portion of alignment system 100 is illustrated, including receptacle 150 loaded with a seventh article 1900. A portion of a seventh sheet 1930 comprising at least a ninth sheet portion 1935 is depicted above receptacle 150. For purposes of illustration, two examples of seventh sheet 1930 are included, representing two states or configurations of seventh sheet 1930. A first state 1950 represents the flattened configuration (similar to the first position of first sheet 250 in FIG. 6) of seventh sheet 1930, and a second state 1952 represents a deformed or curved configuration of seventh sheet 1930.

First state 1950 shows the general boundaries of a ninth aperture 1960 and a tenth aperture 1962 disposed along ninth sheet portion 1935 of seventh sheet 1930. As noted above, in different embodiments, each aperture may comprise varying dimensions and shapes. In FIG. 19, ninth aperture 1960 has a perimeter with a generally elongated oval shape, and tenth aperture 1962 has a perimeter with a generally oblong rectangular shape. Furthermore, ninth aperture 1960 includes a ninth length 1970 (extending in a direction substantially aligned with longitudinal axis 180) and a ninth width 1980 (extending in a direction substantially aligned with lateral axis 190). Tenth aperture 1962 includes a fourth length 1972 (extending in a direction substantially aligned with longitudinal axis 180) and a fourth width 1982 (extending in a direction substantially aligned with lateral axis 190). In some embodiments, the lengths and/or widths (and other relevant dimensions) associated with the apertures disposed in a single sheet portion may be substantially similar. In other embodiments, the dimensions between two or more apertures may differ. Furthermore, in other embodiments, there may be fewer apertures, or a greater number of apertures.

For example, in FIG. 19, ninth length 1970 is greater than tenth length 1972. In addition, ninth width 1980 is greater than tenth width 1982. Thus, it can also be seen that the area associated with ninth aperture 1960 is larger than the area associated with tenth aperture 1962. However, it should be understood that in other embodiments, ninth length 1970 may be substantially similar to or less than tenth length 1972. Similarly, ninth width 1980 may be substantially similar to or less than tenth width 1982 in different embodiments.

Furthermore, referring to FIGS. 18 and 19, in some embodiments, the sheet reference markers associated with seventh sheet 1930 (comprising ninth aperture 1960 and tenth aperture 1962) may differ from the sheet reference markers associated with sixth sheet 1830 (comprising seventh aperture 1860 and eighth aperture 1862). In some embodiments, there may be a greater number or a fewer number of apertures in sixth sheet 1830 relative to seventh sheet 1930. In another embodiment, the relative position of one or more apertures along sixth sheet 1830 may differ from the relative position of one or more apertures along seventh sheet 1930. For example, the lengths associated with seventh aperture 1860 and eighth aperture 1862 are elongated in a direction substantially aligned with lateral axis 190, while the lengths associated with ninth aperture 1960 and tenth aperture 1962 are elongated in a direction substantially aligned with longitudinal axis 180. However, in some embodiments, there may be similarly situated apertures and/or the same number of apertures between two or more flexible sheets.

In addition, in some embodiments, the dimensions of apertures across different sheets can vary. As noted above, each aperture may be associated with different shapes or areas. For example, ninth length 1970 of ninth aperture 1960 is greater than seventh length 1870 of seventh aperture 1860. In another example, tenth length 1972 of tenth aperture 1962 is greater than eighth length 1872 of eighth aperture 1862. In some embodiments, for example embodiments where there are the same number of apertures between two or more flexible sheets (as shown in FIGS. 18 and 19), the apertures may be differently sized. The apertures or other sheet reference markers may be adjusted in order to accommodate article reference regions associated with different article types in some embodiments. However, it should be understood that in other embodiments, ninth length 1970 may be substantially similar to or less than seventh length 1870, and tenth length 1972 may be substantially similar to or less than eighth length 1872.

Thus, in some embodiments, one sheet portion may be sized to provide an alignment reference for an article of a particular type. For example, ninth sheet portion 1935 may be configured for use with seventh article 1900, which may be designed for a second athletic activity. In some embodiments, the first athletic activity of FIG. 18 is different than the second athletic activity of FIG. 19. In some embodiments, the flexible sheet may include one or more apertures that are specifically configured to correspond with one or more reference regions for a particular article type. In FIG. 19, reference regions 1988 include a ninth reference region 1990 and a tenth reference region 1992. To better illustrate the alignment that can occur or be arranged between a sheet and an article, an example of the alignment between the apertures of ninth sheet portion 1935 (in deformed second state 1952) and reference regions 1988 is depicted using dotted lines. It can be seen that the area and shape associated with ninth reference region 1990 is substantially similar to the area and shape associated with ninth aperture 1960. Furthermore, the area and shape associated with tenth reference region 1992 is substantially similar to the area and shape associated with tenth aperture 1962. In other words, in some embodiments, seventh sheet 1930 can be configured such that when seventh sheet 1930 contacts a particular article (here an article with a second standard size), the sheet reference marker(s) can become substantially aligned with the article reference region(s). In some embodiments, some adjustment of the position of the article on receptacle 150 may be needed to improve and/or "hone" the alignment between the sheet reference markers and the article reference regions. Thus, it can be again understood that a flexible sheet may be configured (or manufactured) for use with a specific article size or article type, such that the reference markers of the sheet correspond with the reference regions of the article.

In different embodiments, as described above, another sheet or sheet portion may be designed or manufactured to accommodate or align with article reference regions of another type. In some cases, a specific sheet portion (or flexible sheet) may be used as an alignment reference for an article of a different type or an article with a substantially different pattern of reference regions. For example, in FIG. 20, a portion of alignment system 100 is illustrated, including receptacle 150 loaded with an eighth article 2000. A portion of an eighth sheet 2030 comprising at least a tenth sheet portion 2035 is depicted above receptacle 150. For purposes of illustration, two examples of eighth sheet 2030 are included, representing two states or configurations of eighth sheet 2030. A first state 2050 represents the flattened configuration (similar to the first position of first sheet 250 in FIG. 6) of eighth sheet 2030, and a second state 2052 represents a deformed or curved configuration of eighth sheet 2030.

First state 2050 shows the general boundaries of an eleventh aperture 2060 disposed along tenth sheet portion 2035 of eighth sheet 2030. As noted above, in different embodiments, an aperture may comprise varying dimensions and shapes. In FIG. 20, eleventh aperture 2060 has a perimeter with a generally oblong rectangular shape. Furthermore, eleventh aperture 2060 includes an eleventh length 2070 and an eleventh width 2080. In other embodiments, the dimensions between two or more apertures may differ. In other embodiments, there may be fewer apertures, or a greater number of apertures. Thus, in the embodiment of FIG. 20, eighth sheet 2030 has only a single aperture, in contrast to sixth sheet 1830 and seventh sheet 1930 of FIGS. 18 and 19.

Furthermore, referring to FIGS. 18-20, in some embodiments, the sheet reference marker associated with eighth sheet 2030 (comprising eleventh aperture 2060) may differ from the sheet reference markers associated with seventh sheet 1930 (comprising ninth aperture 1960 and tenth aperture 1962) and/or sixth sheet 1830 (comprising seventh aperture 1860 and second aperture 1862). As noted above, there may be a different number of apertures in seventh sheet 1930 and/or sixth sheet 1830 relative to eighth sheet 2030. In another embodiment, the relative position of one or more apertures along seventh sheet 1930 and/or sixth sheet 1830 may differ from the relative position of one or more apertures along eighth sheet 2030. For example, eleventh aperture 2060 is formed such that it encompasses a majority of the area comprising tenth sheet portion 2035. However, in some embodiments, there may be similarly situated apertures and/or the same number of apertures between two or more flexible sheets.

In addition, in some embodiments, the dimensions of apertures across different sheets can vary. For example, as noted above, each aperture may be associated with different shapes or areas. For example, eleventh length 2070 of eleventh aperture 2060 is greater than ninth length 1970 of ninth aperture 1960. Furthermore, eleventh width 2080 of eleventh aperture 2060 is greater than ninth width 1980 of ninth aperture 1960. It can also be seen that the area associated with eleventh aperture 2060 is substantially larger than the area associated with either ninth aperture 1960 or tenth aperture 1962. Thus, in some embodiments, one sheet portion may include reference markers sized to provide an alignment reference for an article of a particular type.

For example, tenth sheet portion 2035 may be configured for use with eighth article 2000, designed for a third athletic activity. In some embodiments, the first athletic activity of FIG. 18 and the second athletic activity of FIG. 19 differ from the third athletic activity of FIG. 20. In some embodiments, a sheet may include one or more apertures that are specifically configured to correspond with one or more reference regions for a particular article size. In FIG. 20, reference regions 2088 include an eleventh reference region 2090. To better illustrate the alignment that can occur or be arranged between a sheet and an article, an example of the alignment between the apertures of tenth sheet portion 2035 (in deformed second state 2052) and reference regions 2088 is depicted using dotted lines. It can be seen that the area and shape associated with eleventh reference region 2090 is substantially similar to the area and shape associated with eleventh aperture 2060. In other words, in some embodiments, eighth sheet 2030 can be configured such that when eighth sheet 2030 contacts a particular article (here an article with a third standard size), the sheet reference marker(s) can be substantially aligned with the article reference region(s). In some embodiments, some adjustment of the position of the article on receptacle 150 may be needed to improve and/or "hone" the alignment between the sheet reference markers and the article reference regions. Thus, in different embodiments, a flexible sheet of the present disclosure may be configured (or manufactured) for use with a specific article size or article type, such that the reference markers of the sheet correspond with the reference regions of the article.

Figure 21:
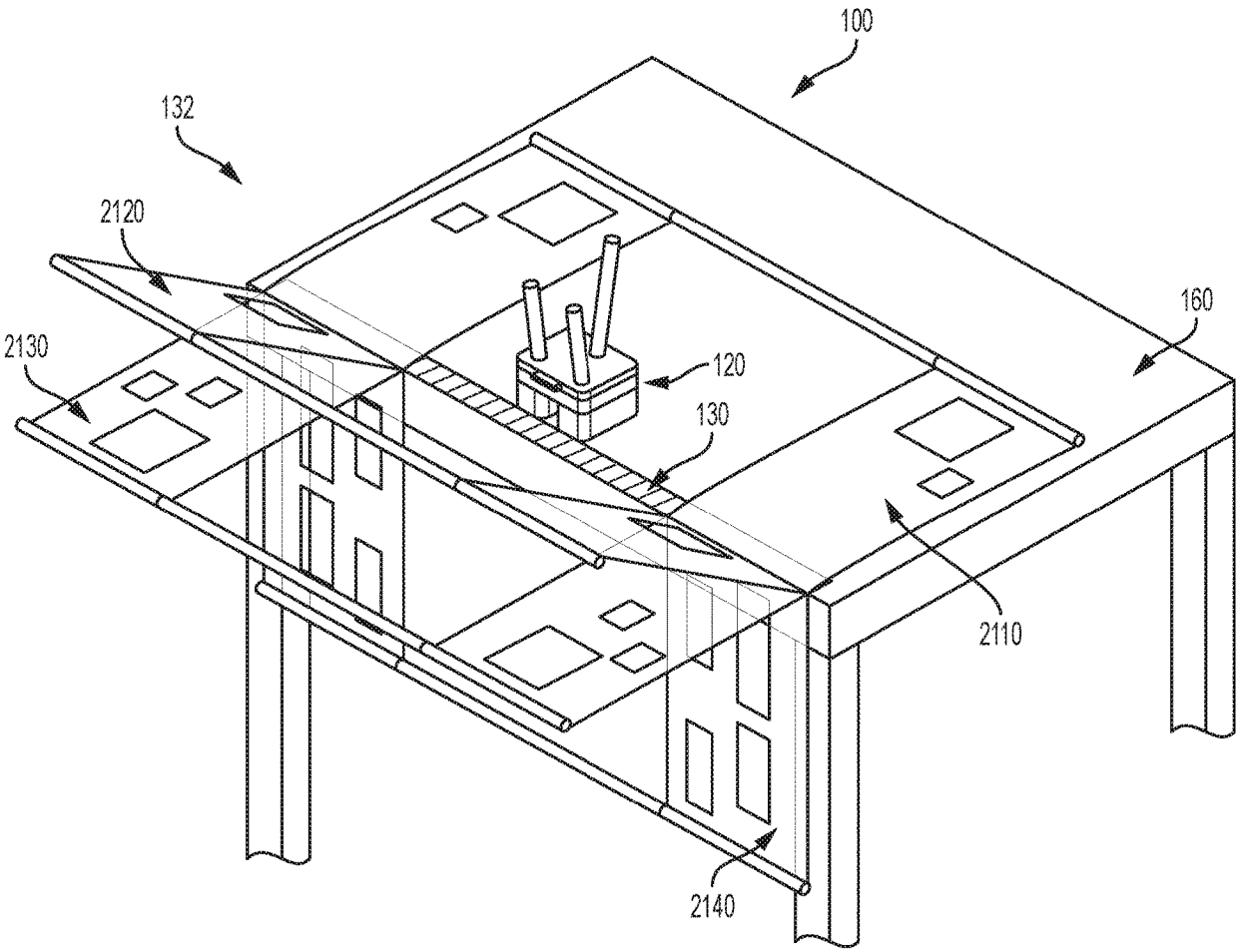
FIG. 21 is a schematic view of an embodiment of a plurality of flexible sheets in an alignment system.

As described previously, in different embodiments, one or more sheets 132 may be joined to anchoring member 130 in alignment system 100. Referring now to FIG. 21, an additional embodiment of alignment system 100 is depicted, where the system includes four sheets 132. In FIG. 21, alignment system 100 includes a first sheet 2110, a second sheet 2120, a third sheet 2130, and a fourth sheet 2140. As described above with respect to FIGS. 15-20, each sheet can be configured for use with a range of article sizes and/or types. Thus, multiple sheets 132 may be "sandwiched" or otherwise disposed between other sheets in some embodiments. As illustrated in FIG. 21, first sheet 2110 is shown in a first position (similar to the first position of FIG. 6). Second sheet 2120 is shown in a second position, third sheet 2130 is shown in a third position, and fourth sheet is shown in a fourth position 2140. In some embodiments, as a result of the flexible manner of attachment between sheets 132 and anchoring member 130, each sheet may be moved such that it can generally occupy any of first position, second position, third position, or fourth position (or any position between). In some embodiments, sheets 132 may be likened to the pages of a book or magazine, where the spine of the book may provide a similar function as anchoring member 130. In other words, each sheet may be turned in either a clockwise or counterclockwise direction (see FIGS. 12-14). In some embodiments, in order to move a sheet from the first position to the fourth position, receptacle 150 may be lifted or adjusted to allow the sheet to move freely.

In some embodiments, the inclusion of multiple sheets in alignment system 100 can provide a user with ready and easy access to templates for multiple article types and/or sizes. Thus, in one embodiment, receptacle 150 may be inserted in receiving assembly 110 with a first pair of articles and aligned using first sheet 2110. Receptacle 150 may then be removed, and a second receptacle loaded with a second, different pair of articles can be inserted in receiving assembly 110. The second pair of articles can be aligned using second sheet 2120, for example. In another embodiment, receptacle 150 may be inserted in receiving assembly 110 with a first pair of articles and aligned using first sheet 2110, the receptacle may be removed for printing, and the same receptacle with a different pair of articles may be mounted in the alignment system. Thus, in some embodiments, alignment system 100 may facilitate the alignment process for a variety of articles.

Figure 22:
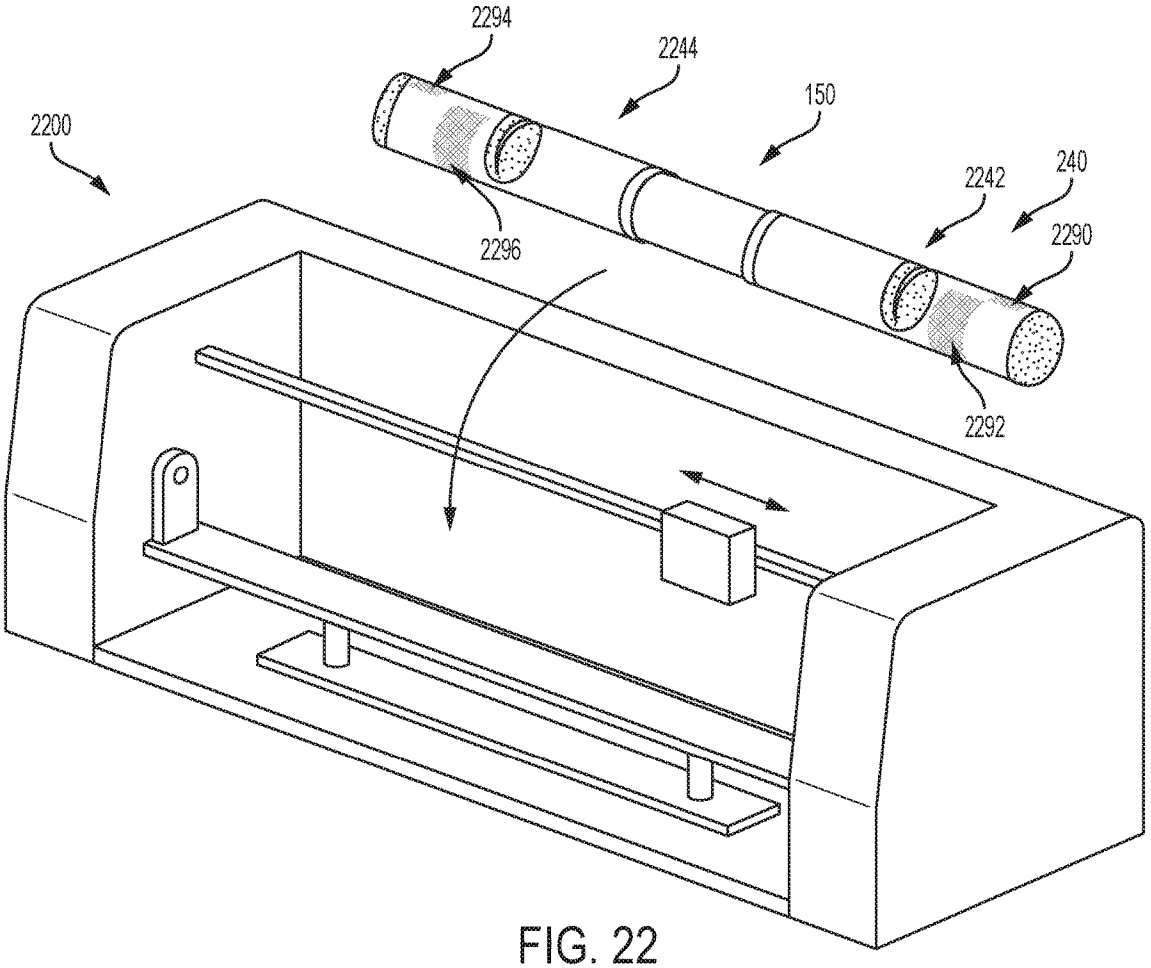
FIG. 22 is a schematic view of an embodiment of a receptacle device and a printing system.

Referring now to FIG. 22, in some embodiments, receptacle 150 can include provisions that allow receptacle 150 and articles 240 to be easily moved or transported. In some cases, receptacle 150 is designed to be self-contained and easily removed from its current location. Some embodiments can be sized so that one person is able to move receptacle 150 without requiring the use of a mechanical lift, and may thus be man-portable. Furthermore, the receptacle may be of a weight configured to be moved by a single person. For example, in some exemplary embodiments, the housing may comprise a weight between 0.5 kg and 40 kg. In other embodiments, receptacle 150 may weigh between 0.1 kg and 50 kg.

Once receptacle 150 and corresponding articles 240 have been aligned using alignment system 100 as described above, it may be desired to move receptacle 150 to a printing system for printing on article 240. In different embodiments, the printing system utilized with alignment system 100 may vary widely. Some examples of systems that may be utilized by the disclosed embodiments are described in Ernst et al., U.S. Patent Publication Number 2016/0347086, published Dec. 1, 2016, (previously U.S. patent application Ser. No. 14/723,756, filed May 28, 2015), titled "Printing System For Apparel,"; Bevier et al., U.S. Pat. No. 9,102,167, issued Aug. 11, 2015 (previously U.S. patent application Ser. No. 14/094,946, filed Dec. 3, 2013), titled "Method of Printing Onto Apparel And Apparatus"; Bevier et al., U.S. Patent Publication Number 2016/0339472, published Nov. 24, 2016, (previously U.S. patent application Ser. No. 14/718,805, filed May 21, 2015), titled "Method And Apparatus For Retaining And Transferring An Article,"; Ernst et al., U.S. Patent Publication Number 2016/0347099, published Dec. 1, 2016, (previously U.S. patent application Ser. No. 14/996,485, filed Jan. 15, 2016), titled "Printing System for Apparel, "; Craig et al., U.S. Patent Publication Number 2011/0265252, published Nov. 3, 2011, titled "A Sock and A Method For Its Manufacture," the disclosures of each of which are incorporated herein by reference in their entirety. As shown in FIG. 22, in some embodiments, receptacle 150 may be inserted or mounted into a printing system 2200. Printing system 2200 may include provisions for maintaining receptacle 150 in the position and/or orientation required to ensure the appropriate alignment of articles 240 with printing system 2200.

In some embodiments, the various reference regions associated with an article can facilitate the alignment and positioning of receptacle 150 within printing system 2200. In FIG. 22, a first article 2242 and a second article 2244 are mounted on receptacle 150. First article 2242 has a first reference region 2290 and a second reference region 2292, and second article 2244 has a third reference region 2294 and a fourth reference region 2296. Through the use of the alignment system, each article has been loaded onto receptacle 150 and arranged to have a specific position relative to receptacle 150. In one embodiment, each reference region is now positioned to line up in a particular manner with printing patterns that may be produced using printing system 2200.

Figure 23:
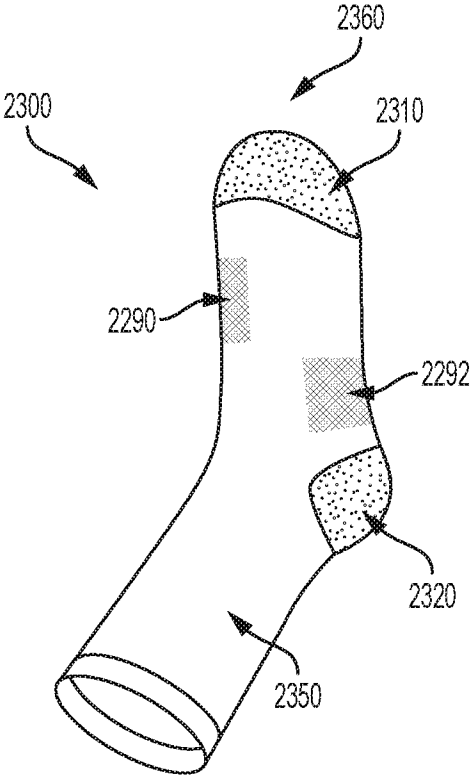
FIG. 23 is an isometric view of an embodiment of an article of apparel.

Thus, in different embodiments, the use of alignment system 100 can facilitate printing on a variety of articles. In some embodiments, the alignment system can allow articles such as socks to be registered for printing even when the socks have knitted designs that are not linear. For example, in some embodiments, there may be socks that include particular regions on which printing is not desired. Referring to FIG. 23, a first sock 2300 is shown in isolation. In some embodiments, only the white or blank areas 2350 may require printing. For example, in those embodiments where the user does not desire printing to occur on any darker (stippled) regions 2360, an alignment system may include a template (e.g., flexible sheets) that includes reference markers corresponding to stippled regions 2360. In other words, in one embodiment, a flexible sheet may be configured for application on an article with apertures (sheet reference markers) that can match and correspond with the article reference regions of first sock 2300 when the sheet is wrapped around first sock 2300. In this embodiment, the article reference regions comprise a first stippled region 2310 and a second stippled region 2320. It should be understood that in other embodiments, it may be desired that the stippled regions receive printing, and templates or printing patterns can be altered to accommodate the desired regions of printing. Furthermore, the design or configuration of first sock 2300 can vary widely from the example presented here.

Figure 24:
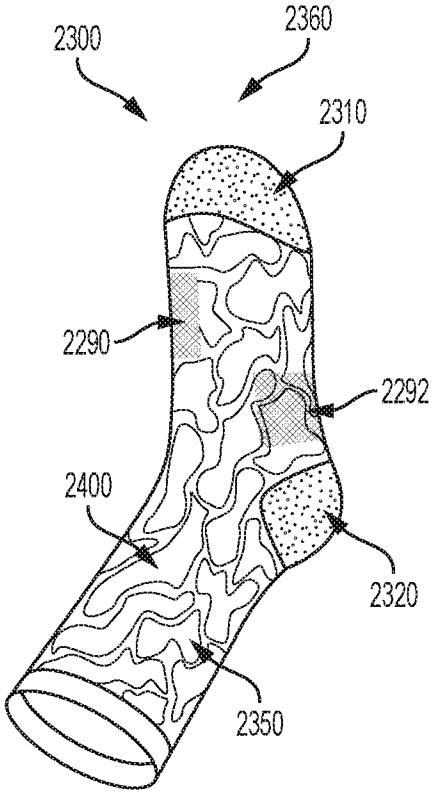
FIG. 24 is an isometric view of an embodiment of an article of apparel.

As a result of using the alignment system, first sock 2300 may be placed in a printing system, and readily registered and aligned for printing. In one embodiment, printing may be limited to white areas 2350 and excluded from stippled regions 2360, as shown in FIG. 24, which illustrates a print design 2400 that has been printed over the (previously) white areas of first sock 2300. Thus, in some embodiments, the use of an alignment system can preserve ink by limiting the application of ink to specified regions of the article. The alignment system may also improve results on durability tests and ink fastening tests that can occur during manufacturing of printed articles. For example, as darker regions of an article typically do not accept additional dye, the alignment system can help protect and/or preclude printing from those regions.

The processes of alignment and printing disclosed herein may occur in rapid succession and in close proximity to one another in some embodiments. However, in other embodiments, one or more steps may occur spaced apart in time and location. In other words, the alignment may occur in a first location, and the printing may occur in a second location, where the first location is different from the second location. For example, the alignment of an article with respect to a receptacle may occur at a first site (e.g., at a manufacturing facility or industrial office location, etc.), and the printing on the article may occur in a second site, such as a shopping outlet or a retail store. In another example, the two processes may occur in close proximity to one another.

Figure 25:
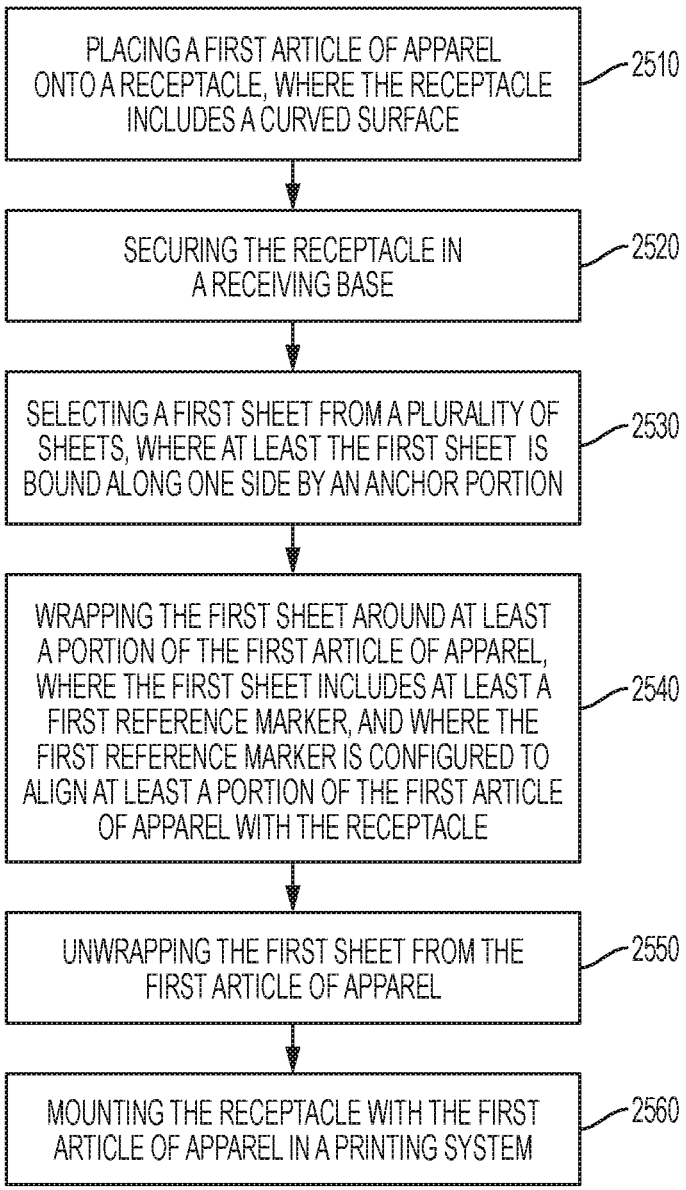
FIG. 25 is an embodiment of a flowchart for a method of using an alignment system.

Referring to FIG. 25, an embodiment of a method of using an alignment system is outlined. In some embodiments, a first step 2510 can include placing a first article of apparel onto a receptacle, where the receptacle includes a curved surface. A second step 2520 includes securing the receptacle in a receiving base. A third step 2530 can comprise selecting a first sheet from a plurality of sheets, where at least the first sheet is bound along one side by an anchor portion. Furthermore, a fourth step 2540 includes wrapping the first sheet around at least a portion of the first article of apparel, where the first sheet includes at least a first reference marker, and the first reference marker being configured to align at least a portion of the first article of apparel with the receptacle. In a fifth step 2550, the first sheet may be unwrapped or removed from the first article of apparel. Finally, in a sixth step 2560, the receptacle (with the first article of apparel) may be mounted in a printing system.

In other embodiments, some steps may be omitted, and/or additional steps may be included. For example, other steps could include removing the first article of apparel from the receptacle and placing a second article of apparel onto the receptacle, selecting a second sheet from the plurality of sheets, and wrapping the second sheet around at least a portion of the second article of apparel. In some embodiments, the second sheet includes a second reference marker, and the second reference marker is configured to align at least a portion of the second article of apparel with the receptacle. In addition, some embodiments could include placing a second article of apparel onto the receptacle and wrapping the first sheet around at least a portion of the second article of apparel as well as the first article of apparel. In some cases, the first sheet includes a second reference marker that is configured to align at least a portion of the second article of apparel with the receptacle. In other embodiments, a releasable retaining component can be associated with the receiving base to secure the first sheet in position relative to the receptacle.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An alignment system for printing comprising:

a receptacle configured to receive a first article of apparel, wherein the receptacle has a three-dimensional geometry and includes at least one curved surface;

a receiving base, wherein the receiving base is configured to receive the receptacle;

a first sheet, wherein one side of the first sheet is fixed in position relative to the receiving base, and wherein the first sheet is configured to curve and extend around a portion of a circumference of the receptacle; and wherein the first sheet includes at least a first reference marker, and wherein the first reference marker is configured to align at least a portion of the first article of apparel with the receptacle.

2. The alignment system of claim 1, wherein the receptacle has a substantially cylindrical shape.

3. The alignment system of claim 1, wherein the first sheet includes a first sheet portion and a second sheet portion, wherein the first sheet portion has a first edge, wherein the second sheet portion has a second edge, and wherein the first edge and the second edge are joined to a first support member.

4. The alignment system of claim 1, wherein one side of the first sheet is attached to an anchoring portion.

5. The alignment system of claim 1, further comprising:

the receptacle being configured to receive a second article of apparel, where the second article of apparel is different from the first article of apparel;

a second sheet, wherein the second sheet is fixed in position relative to the receiving base, and wherein the second sheet is configured to curve and extend around a portion of the circumference of the receptacle; and wherein the second sheet includes a second reference marker, and wherein the second reference marker is configured to align at least a portion of the second article of apparel with the receptacle.

6. The alignment system of claim 5, wherein the second article of apparel is a larger standard fitting size than the first article of apparel.

7. The alignment system of claim 5, wherein the first reference marker in the first sheet and the second reference marker in the second sheet are unaligned when the first sheet is disposed over the second sheet.

8. The alignment system of claim 1, wherein the first reference marker comprises an aperture within the first sheet.

9. The alignment system of claim 1, wherein the first reference marker is configured to align with a first reference region associated with the first article of apparel.

10. The alignment system of claim 9, wherein the first sheet further includes a second reference marker, and wherein the second reference marker is configured to align with a second reference region associated with the first article of apparel.

11. An alignment system for printing comprising:

a receptacle with a three-dimensional geometry, the receptacle including an outer surface;

at least a portion of the outer surface of the receptacle being configured to receive a first article of apparel;

a receiving base, wherein the receiving base is configured to receive the receptacle;

the outer surface including a lower region and an upper region;

a first sheet configured to curve and extend around at least a portion of the lower region of the receptacle and at least a portion of the upper region of the receptacle when the receptacle is disposed in the receiving base;

wherein the first sheet has a first edge that is joined to a first support member;

wherein the receiving base includes a releasable retaining component;

wherein the releasable retaining component is configured to engage with a portion of the first support member when the first sheet is extended around the receptacle; and wherein the releasable retaining component and the portion of the first support member are configured to secure the first sheet in position relative to the receptacle.

12. The alignment system of claim 11, wherein the receptacle is configured to receive both the first article of apparel and a second article of apparel simultaneously.

13. The alignment system of claim 12, wherein the first sheet includes a first sheet portion and a second sheet portion, wherein the first sheet portion is configured to extend around a portion of the receptacle that is associated with the first article of apparel, and wherein the second sheet portion is configured to extend around the portion of the receptacle that is associated with the second article of apparel.

14. The alignment system of claim 11, wherein the releasable retaining component includes a positive locking system, and wherein the positive locking system includes a magnetic element.

15. The alignment system of claim 14, wherein the magnetic element helps to removably attach the first support member to the receiving base when the first sheet extends around the receptacle.

16. A method of operating a system for aligning an article of apparel, comprising:

placing a first article of apparel onto a receptacle, the receptacle including a curved surface;

securing the receptacle in a receiving base;

selecting a first sheet from a plurality of sheets, wherein at least the first sheet is bound along one side by an anchor portion;

wrapping the first sheet around at least a portion of the first article of apparel, wherein the first sheet includes at least a first reference marker, the first reference marker being configured to align at least the portion of the first article of apparel with the receptacle;

unwrapping the first sheet from the first article of apparel; and mounting the receptacle with the first article of apparel in a printing system.

17. The method of operating the system of claim 16, further comprising:

removing the first article of apparel from the receptacle;

placing a second article of apparel onto the receptacle;

securing the receptacle with the second article of apparel in the receiving base;

selecting a second sheet from the plurality of sheets, wherein the second sheet is bound along one side by the anchor portion;

wrapping the second sheet around at least a portion of the second article of apparel, wherein the second sheet includes a second reference marker, the second reference marker being configured to align at least the portion of the second article of apparel with the receptacle.

18. The method of operating the system of claim 16, further comprising:

placing a second article of apparel onto the receptacle;

wrapping the first sheet around at least a portion of the second article of apparel, wherein the first sheet includes a second reference marker, the second reference marker being configured to align at least the portion of the second article of apparel with the receptacle.

19. The method of operating the system of claim 16, further comprising using a releasable retaining component that is associated with the receiving base to secure the first sheet in position relative to the receptacle.

20. A method of making a sock, comprising:

placing the sock onto a receptacle, the receptacle including a curved surface;

securing the receptacle in a receiving base;

selecting a first sheet from a plurality of sheets, wherein at least the first sheet is bound along one side by an anchor portion;

wrapping the first sheet around at least a portion of the sock, wherein the first sheet includes at least a first reference marker, the first reference marker being configured to align at least the portion of the first sock with the receptacle;

unwrapping the first sheet from the sock;

mounting the receptacle with the sock in a printing system; and printing on a first region of the sock and excluding printing from a second region of the sock.

* * * * *